US005880388A

United States Patent [19]

Kajiyama et al.

[11] Patent Number: 5,880,388

[45] Date of Patent: Mar. 9, 1999

[54] KARAOKE SYSTEM FOR SYNCHRONIZING AND REPRODUCING A PERFORMANCE DATA, AND KARAOKE SYSTEM CONFIGURATION METHOD

[75] Inventors: Ryo Kajiyama; Seiji Tsutsui, both of Kawasaki; Hitoshi Sakazume, Inagi; Yukikazu Emori, Nagano, all of Japan

[73] Assignee: Fujitsu Limited, Kawasaki, Japan

[21] Appl. No.: 610,765

[22] Filed: Mar. 5, 1996

[30] Foreign Application Priority Data

Mar. 6, 1995 [JP] Japan ..... 7-072366
Mar. 15, 1995 [JP] Japan ..... 7-084672

[51] Int. Cl.[6] ..... G10H 7/00; G10H 1/36

[52] U.S. Cl. ..... 84/609; 84/610; 84/634; 84/649; 84/650; 434/307 A

[58] Field of Search ..... 434/307 A; 84/609–610, 84/612, 634, 636, 649, 650, 652, 666, 668

[56] References Cited

U.S. PATENT DOCUMENTS

| | | | |
|---|---|---|---|
| 5,159,670 | 10/1992 | Suzuki et al. . | |
| 5,243,582 | 9/1993 | Yamauchi et al. | 369/32 |
| 5,247,126 | 9/1993 | Okamura et al. | 84/609 |
| 5,315,570 | 5/1994 | Miura et al. . | |
| 5,341,253 | 8/1994 | Liao et al. | 360/61 |
| 5,392,264 | 2/1995 | Hira . | |
| 5,397,853 | 3/1995 | Koguchi | 84/609 |
| 5,414,686 | 5/1995 | Iitsuka | 369/48 |
| 5,446,714 | 8/1995 | Yoshio et al. | 369/48 |
| 5,465,240 | 11/1995 | Mankovitz | 369/1 |
| 5,481,509 | 1/1996 | Knowles . | |
| 5,499,922 | 3/1996 | Umeda et al. | 434/307 A |
| 5,550,735 | 8/1996 | Slade et al. . | |
| 5,557,590 | 9/1996 | Matsumoto et al. . | |
| 5,561,815 | 10/1996 | Takata et al. . | |
| 5,611,693 | 3/1997 | Chaya et al. . | |
| 5,625,610 | 4/1997 | Hiranuma . | |

FOREIGN PATENT DOCUMENTS

| | | |
|---|---|---|
| 63-147196 | 6/1988 | Japan . |
| 1-158687 | 6/1989 | Japan . |
| 5-28719 | 2/1993 | Japan . |
| 5-128814 | 5/1993 | Japan . |
| 5-144238 | 6/1993 | Japan . |
| 5-166344 | 7/1993 | Japan . |
| 6-111469 | 4/1994 | Japan . |
| 7-14299 | 1/1995 | Japan . |

OTHER PUBLICATIONS

English translation of the Summary of the Invention for Japanese Patent No. 63–147196, issued Jun. 20, 1988 to Kotani, et al. attached to copy of Japanese Patent No. 63–147196.

English Abstract for Japanese Patent No. 5–28719, issued Feb. 5, 1993 to Sone, et al.

English Abstract for Japanese Patent No. 5–128814, issued May 25, 1993 to Tsuneyoshi.

English Abstract for Japanese Patent No. 5–166344, issued Jul. 2, 1993 to Matsumoto.

*Primary Examiner*—William M. Shoop, Jr.
*Assistant Examiner*—Marlon T. Fletcher
*Attorney, Agent, or Firm*—Staas & Halsey

[57] ABSTRACT

A first reading unit reads first performance data from a first storage medium, and outputs it to a reproducing unit. A second reading unit reads second performance data from a second storage medium, and outputs it to the reproducing unit. The reproducing unit reproduces the first performance data inputted from the first reading unit, and the second performance data inputted from the second reading unit. A control unit synchronizes reproduction of the first performance data and reproduction of the second performance data, and switches between these reproductions.

48 Claims, 22 Drawing Sheets

FIG. 8A

330 INFORMATION

| | |
|---|---|
| | TITLE IN FOREIGN LANGUAGE |
| | PRONUNCIATION OF TITLE IN FOREIGN LANGUAGE |
| | TITLE IN JAPANESE |
| | PRONUNCIATION OF TITLE IN JAPANESE |
| 335 | PHOTO (FILE NAME) → JACKET PHOTO FILE (IMAGE) |
| 336 | ALBUM INFORMATION (FILE NAME) → ALBUM INFORMATION FILE(TEXT) |
| 337 | TOTAL PERFORMANCE TIME |
| | ARTIST NAME |
| | PRODUCER NAME |
| | ORIGINAL PUBLISHER NAME |
| | SUBPUBLISHER NAME |
| | COPYRIGHT |
| 338 | NUMBER OF MUSIC PIECES |

FIG. 8B

340 ARTIST INFORMATION

| | |
|---|---|
| | NAME |
| | PRONUNCIATION OF NAME |
| 343 | ARTIST INFORMATION (FILE NAME) → ARTIST INFORMATION FILE (TEXT) |
| 344 | PHOTO (FILE NAME) → ARTIST PHOTO FILE (IMAGE) |
| | GENDER |

FIG. 8C

350 MUSIC PIECE INFORMATION

| | |
|---|---|
| | CD NAME |
| | ARTIST NAME |
| | SONG WRITER |
| | COMPOSER |
| | ARRANGER |
| | MUSIC PIECE NUMBER IN CD |
| 357 | PERFORMANCE TIME |
| 358 | WORDS (FILE NAME) → WORD FILE (TEXT) |
| 359 | MIDI (FILE NAME) → MIDI FILE (MIDI) |
| | COPYRIGHT |
| | TITLE IN JAPANESE |
| | PRONUNCIATION OF TITLE IN JAPANESE |
| | TITLE IN FOREIGN LANGUAGE |
| | PRONUNCIATION OF TITLE IN FOREIGN LANGUAGE |

FIG. 15

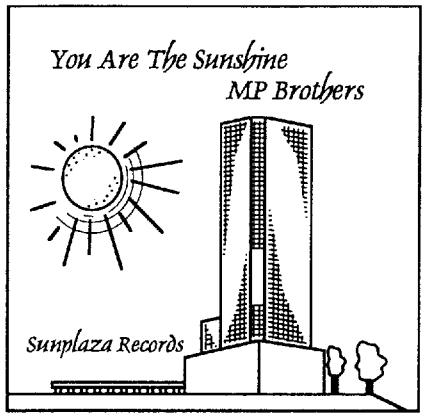

405

LAY DOWN MY LOVE
NOW IT
TEARS FALLING ON FACE
TOO HIGH MOUNTAIN
EVERY ONE
NIGHT TRAIN
CALL ME AGAIN
LOVING YOU SO MUCH
BOOGIE ON BOOGIE
YOU ARE THE SUNSHINE

406

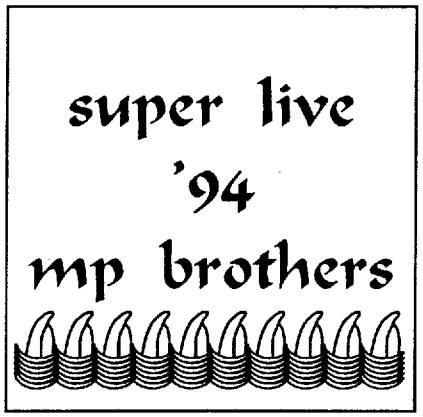

HOLD OUT
WISHFUL THINKING MORE
TAKE IT EASY
AUTUMN PICTURE
VERY SUPERSTITION
IT'S NEVER TOO FAST
HAVE YOU NEVER BEEN
WOMAN AND MAN
DOWN TOWN BOY
GOODBYE AGAIN

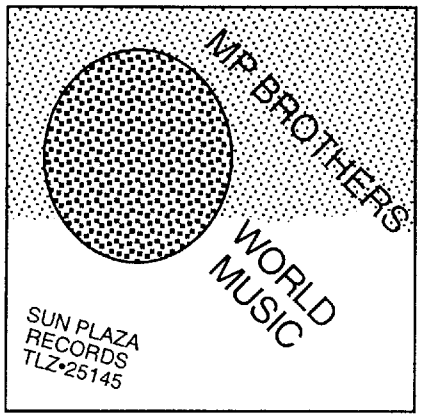

STANDING IN THE MORNING
COLOR LIFE
TO FIVES
LAST NIGHT
SPRING RAIN
MONDAY'S NIGHTMARE
HEARTFULL
LADYS
ONE TWO JUMP

FIG. 19

| WE ARE THE CHALLENGERS | WORDS |
|---|---|
| 俺たちは挑戦者だ | TRANSLATION |
| ウィ アー ザ チャレンジャーズ | PRONUNCIATION |
| 1, 00:20:44 | CD PHRASE START TIME (1) |
| 1, 00:25:70 | CD PHRASE END TIME (2) |
| 17, 0 | MIDI PHRASE START TIME (3) |
| 19, 0 | MIDI PHRASE END TIME (4) |

FIG. 22

(WHEN ORIGINAL TRACK IS 1 AND KARAOKE TRACK IS 3)

| | | |
|---|---|---|
| WE ARE THE CHALLENGERS | WORDS | |
| 俺たちは挑戦者だ | TRANSLATION | |
| ウィ アー ザ チャレンジャーズ | PRONUNCIATION | |
| 1, 00:20:44 | ORIGINAL PHRASE START TIME | 1 |
| 1, 00:25:70 | ORIGINAL PHRASE END TIME | 2 |
| 3, 00:20:44 | KARAOKE PHRASE START TIME | 3 |
| 3, 00:25:70 | KARAOKE PHRASE END TIME | 4 |

KARAOKE SYSTEM FOR SYNCHRONIZING AND REPRODUCING A PERFORMANCE DATA, AND KARAOKE SYSTEM CONFIGURATION METHOD

BACKGROUND OF THE INVENTION

1. Field of the Invention

The present invention relates to a system for reproducing data stored on a storage medium, and more particularly, to a karaoke system for synchronizing and reproducing a first and a second performance data.

2. Description of the Related Art

In recent years, that which is called karaoke has widely spread as a readily-enjoyable amusement. The word karaoke means "orchestral music without a singer" in Japanese. With karaoke, a recording of only a musical accompaniment of a song is played back, so that people can enjoy singing the song to the tune of the accompaniment being played back.

The popularity of karaoke is also proved by the fact that a single music CD often includes a karaoke version in addition to an original version by an artist.

One way of further enjoying karaoke is to increase a user's repertoire. This means that, for example, a person masters a favorite song which is newly released in order to be able to sing it in his or her own way. To do so, for example, after the person repeatedly listens to the song which he or she wants to add to their repertoire, he or she sings it to the tune of the karaoke version.

Since a compact disc (hereinafter abbreviated to CD) is widely used as a storage medium for storing performance information of a music piece, practice of singing is normally performed with music pieces. It is difficult for a user who is not familiar with the song to grasp the timing, if an artists singing is not included while playing back the music piece. On the other hand, if the artists singing is simultaneously reproduced, the user finds it difficult to identify the level of his or her singing.

As conventional techniques, TOKKAIHEI 5-28719 discloses the karaoke system for recording icon symbol information that images contents of each music piece included in the CD, and for selecting a desired music piece by touching an icon symbol of the desired music piece on a touch panel. TOKKAIHEI 5-16634 discloses the electronic musical instrument equipped with a CD player. With this instrument, a music piece number or a movement can be selected by interactively performing keyboard operations. TOKKAIHEI 5-128814 discloses the CD-ROM reader for selecting a music piece by only pressing a music piece number displayed on a touch panel, in order to directly specify the music piece number.

However, no gazettes disclose the system for recording user music data inputted to the tune of a playedback music piece, and reproducing the music data recorded at that time in synchronization with the playedback music piece.

Also the configuration where playback of a music CD and playback of a CD-ROM which stores on information to be added such as image information, etc. and is synchronous with the music CD, which are synchronized using a personal computer, is not yet disclosed.

SUMMARY OF THE INVENTION

The first object of the present invention, which is aimed at solving the above described problems, is to provide a karaoke system which facilitates obtaining a highly effective user practice by reproducing user music data in synchronization with playing back of a music piece.

The second object of this invention is to provide a karaoke system that can easily be operated, by preparing a CD-ROM storing additional information such as image information, etc., which is synchronous with a music CD sold on the market, synchronizing a playback of the above-described music CD with a playback of the above-described CD-ROM, and controlling these playbacks using a personal computer.

The karaoke system according to the first embodiment of the present invention comprises a first reading unit for reading the performance data stored on a first storage medium; a second reading unit for reading the performance data stored on a second storage medium; a reproducing unit for respectively reproducing the performance data read by the first and the second reading units; and a control unit for synchronizing the performance data read by the first reading unit with the performance data read by the second reading unit.

With the above described karaoke system, the performance data respectively stored on different storage media, for example, an original version of a certain music piece and its karaoke version, are switched and reproduced according to a specification made by a user.

The karaoke system according to the second embodiment of the present invention comprises a first reading unit for reading the performance data stored on a first storage medium; a reproducing unit for reproducing the performance data read by the first reading unit; a recording unit for recording music data inputted by the user in synchronization with the reproduction of the performance data stored on the first storage medium by the reproducing unit, on the second storage medium; a second reading unit for reading the music data recorded on a second storage medium by the recording unit; and a control unit for making the reproducing unit reproduce the music data read by the second reading unit in synchronization with the reproduction of the performance data, when the reproducing unit reproduces the performance data read by the first reading unit.

By recording a user's performance to the tune of a playedback music piece, and playing back data of the recorded user performance in synchronization with the playback of the music piece, the user can, for example, easily make a comparison between the artist's singing and his or her singing, so that he or she can identify his or her singing capability and weak points.

The karaoke system according to the third embodiment of the present invention comprises a first reading unit for reading performance data stored on a first storage medium; a second reading unit for reading the performance data stored on a second storage medium; a reproducing unit for respectively reproducing the performance data read by the first and the second reading units; a recording unit for recording music data inputted by a user in synchronization with reproduction of the performance data read by at least one of the first and the second reading units, on a third storage medium; a third reading unit for reading the music data recorded on the third storage medium by the recording unit; and a control unit for making the reproducing unit reproduce the music data read by the third reading unit in synchronization with the reproduction of the performance data, when the reproducing unit reproduces the performance data read by at least one of the first and the second reading units.

With the karaoke system according to the third embodiment, the effect of combining the first and the second embodiments can be obtained.

The karaoke system according to the fourth embodiment of the present invention comprises a reading unit for reading performance data stored on a storage medium; a reproducing unit for reproducing the performance data read by the reading unit; a reproduction point specifying unit for dividing the performance data stored on the storage medium into data in a predetermined unit, and specifying a reproduction point using the data divided into the predetermined unit; and a control unit for making the reading unit read the performance data stored on the storage medium corresponding to a specified reproduction point.

With this system, the user can specify an arbitrary portion of the music piece, so that he or she can intensively listen to or sing a desired phrase or a desired part of a duet, for example.

The karaoke system according to the fifth embodiment of the present invention comprises a reading unit for respectively reading performance data of identical music pieces in different performance types from different storage areas on the storage medium; a reproducing unit for reproducing the performance data read by the reading unit; a reproduction point specifying unit for specifying a reproduction point in a music piece; a performance type specifying unit for specifying the performance data of a different type from a different storage area; and a control unit for changing a reproduction point at which the reading unit reads the performance data, according to at least one of specifications such as a reproduction point specification and a performance type specification respectively made by the reproducing point specifying unit and the performance type specifying unit.

With this karaoke system, the reproduction point is changed according to the reproduction point in the music piece specified by the user or a performance type specified by the user as described above, when the performance data of different types are respectively stored in the different areas on a storage medium, similar to, for example, a single music CD sold on the market these days.

BRIEF DESCRIPTION OF THE DRAWINGS

FIGS. 8A, 8B and 8C show contents of a CD data file according to the third embodiment of the present invention;

FIG. 15 shows an example of the display in the discography mode;

FIG. 19 shows an example of data corresponding to one phrase;

FIG. 22 shows an example of the data corresponding to one phrase of the music CD;

DETAILED DESCRIPTION OF PREFERRED EMBODIMENT

An explanation of a preferred embodiment of each of the units configuring the karaoke system according to the present invention is provided below, referring to FIGS. 1 and 2.

Figure 1:
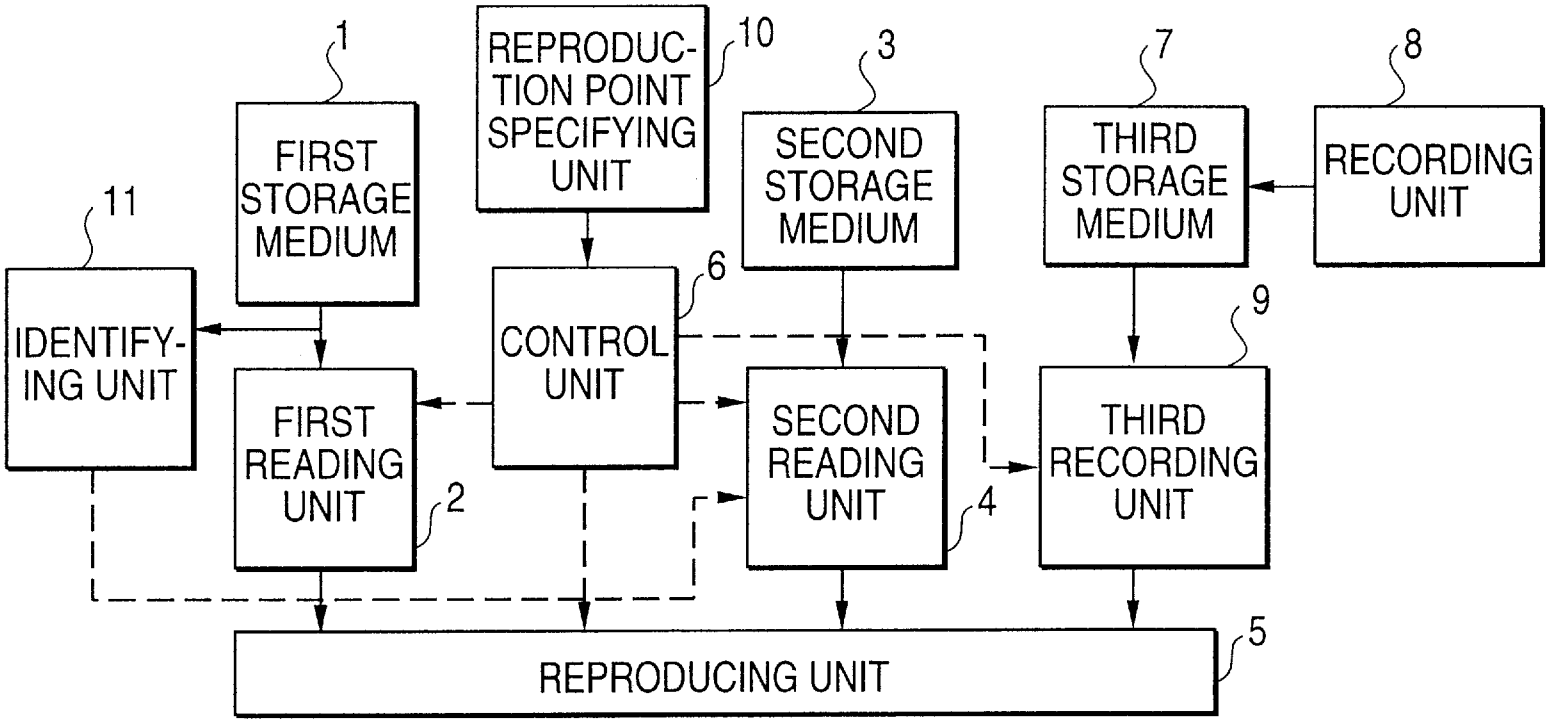
FIG. 1 is a block diagram showing a configuration of the karaoke system according to the first embodiment of the present invention.

FIG. 1 shows the configuration of the karaoke system according to the first embodiment of the present invention.

A first storage medium 1 (for example, a CD) stores performance data of a music piece (for example, music), and a first reading unit 2 reads the performance data.

A second storage medium 3 (for example, a CD-ROM) stores performance data (for example, additional information such as image information, etc.) related to the performance data stored on the first storage medium 1, and a second reading unit 4 reads this performance data.

A reproducing unit 5 reproduces the performance data read by the first reading unit 2 and the second reading unit 4. The reproducing unit 5 may be a unit for simultaneously processing a plurality of performance data, or an aggregate of sound sources allotted to respective reading units. A control unit 6 synchronizes reading the performance data from the first storage medium 1 by the first reading unit 2 with reading the performance data from the second storage medium 3 by the second reading unit 4, and thereby synchronizing a music piece outputted from the reproducing unit 5 depending on these performance data.

In the meantime, the control unit 6 makes the reproducing unit 5 reproduce either of the performance data read by either the first reading unit 2 or the second reading unit 4. For example, if the performance data read by the first reading unit 2 is an original version of a certain music piece and the performance data read by the second reading unit 4 is a karaoke version of that music piece, a user can reproduce a desired portion of the music piece as karaoke music.

A third storage medium 7 records user performance data. A recording unit 8 recording the performance data on the third storage medium 7, stores the user performance data on the third storage medium 7 in synchronization with a music piece being reproduced, while the reproducing unit 5 reproduces the performance data read by at least one of the first reading unit 2 and the second reading unit 4.

A third reading unit 9, which is controlled by the control unit 6, reads the performance data from the third storage medium 7, depending on a state of recording, for example, at a timing of reading the performance data reproduced while recording, from the first storage medium 1 by the first reading unit 2. Thus, reproduction of the performance data read by the first reading unit 2 and reproduction of the performance data read by the third reading unit 9 are synchronized by the reproducing unit 5. The control unit 6 controls a timing of reading the performance data by any of the first through the third reading units 2, 4, and 9 for the above described synchronization, according to, for example, prepared reproduction time information of the performance data stored on the first storage medium 1.

Thus, the music data inputted by the user can be reproduced in synchronization with the reproduction of the music piece.

A reproduction point specifying unit 10 specifies a point at which the music piece is reproduced in a variety of units such as a music piece unit, a phrase unit, etc. The control unit 6 controls the first reading unit 2 and the second reading unit 4 in order to make them read the performance data corresponding to a reproduction point specified by the reproduction point specifying unit 10, using the reproduction time information.

An identifying unit 11 identifies the first storage medium 1 according to predetermined information read from the first storage medium 1 by the first reading unit 2, and makes the second reading unit 4 read the performance data stored on the second storage medium 2 corresponding to the performance data stored on the first storage medium 1.

Figure 2:
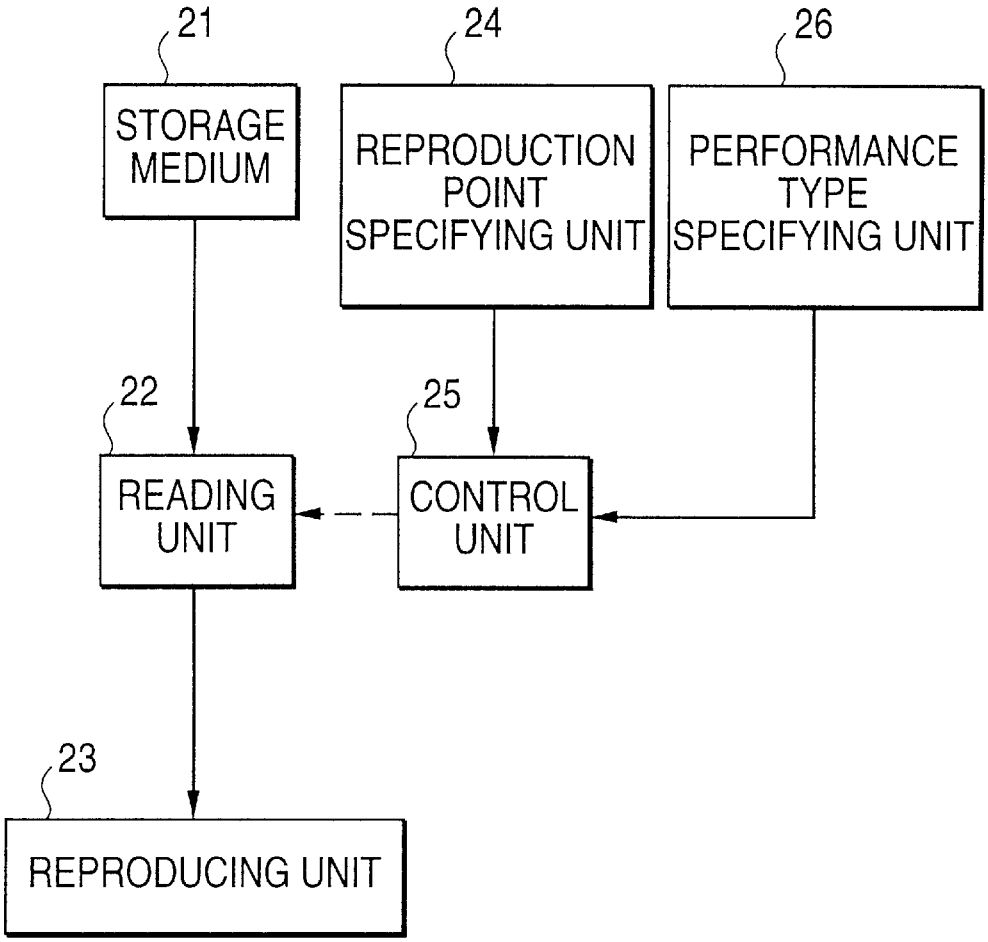
FIG. 2 is a block diagram showing the configuration of the karaoke system according to the second embodiment of the present invention.

FIG. 2 is a principle of the karaoke system according to the second embodiment of the present invention.

A storage medium 21 stores performance data of different types of an identical music piece in different storage areas. A reading unit 22 reads the performance data stored on the storage medium 21. A reproducing unit 23 reproduces the performance data read by the reading unit 22.

A reproduction point specifying unit 24 specifies an arbitrary reproduction point in a music piece in phrases. A control unit 25 obtains the performance data corresponding to the reproduction point specified by the reproduction point specifying unit 24, according to, for example, the performance time information stored on the storage medium 21, and instructs the reading unit 22 to read the performance data corresponding to the reproduction point from the storage medium 21.

A performance type specifying unit 26 specifies a performance type of the performance data stored on the storage medium 21. The control unit 25 instructs the reading unit 22 to read corresponding performance data from the storage medium 21 according to specifications made by the performance type specifying unit 26 and the reproduction point specifying unit 24, and the reproduction time information.

The karaoke system according to the present invention can synchronize and reproduce, for example, performance data respectively stored on different storage media, such as an original version and a karaoke version of a certain music piece, by switching them according to a specification made by a user.

The karaoke system according to the present invention can record a user performance in synchronization with the reproduction of a music piece, so that the recorded data of the user performance can be synchronized with the reproduction of the music piece. With this karaoke system, the user can easily make a comparison between an artist's singing and his or her singigng, so that he or she can easily identify his or her singing capability and weak points at the same time.

The karaoke system according to the present invention changes a portion of the performance data to be reproduced depending on a reproduction point specified by the user. Accordingly, the user can intensively listen to or sing only a desired phrase or a part of a duet, for example.

With the karaoke system according to the present invention, when the performance data of different types are respectively stored on different storage areas on a storage medium, a reproduction point can be moved to an arbitrary point specified by the user, depending on a specification of the performance type.

Further explanation of a preferred embodiment according to the present invention is provided below in detail, referring to the drawings.

Figure 3:
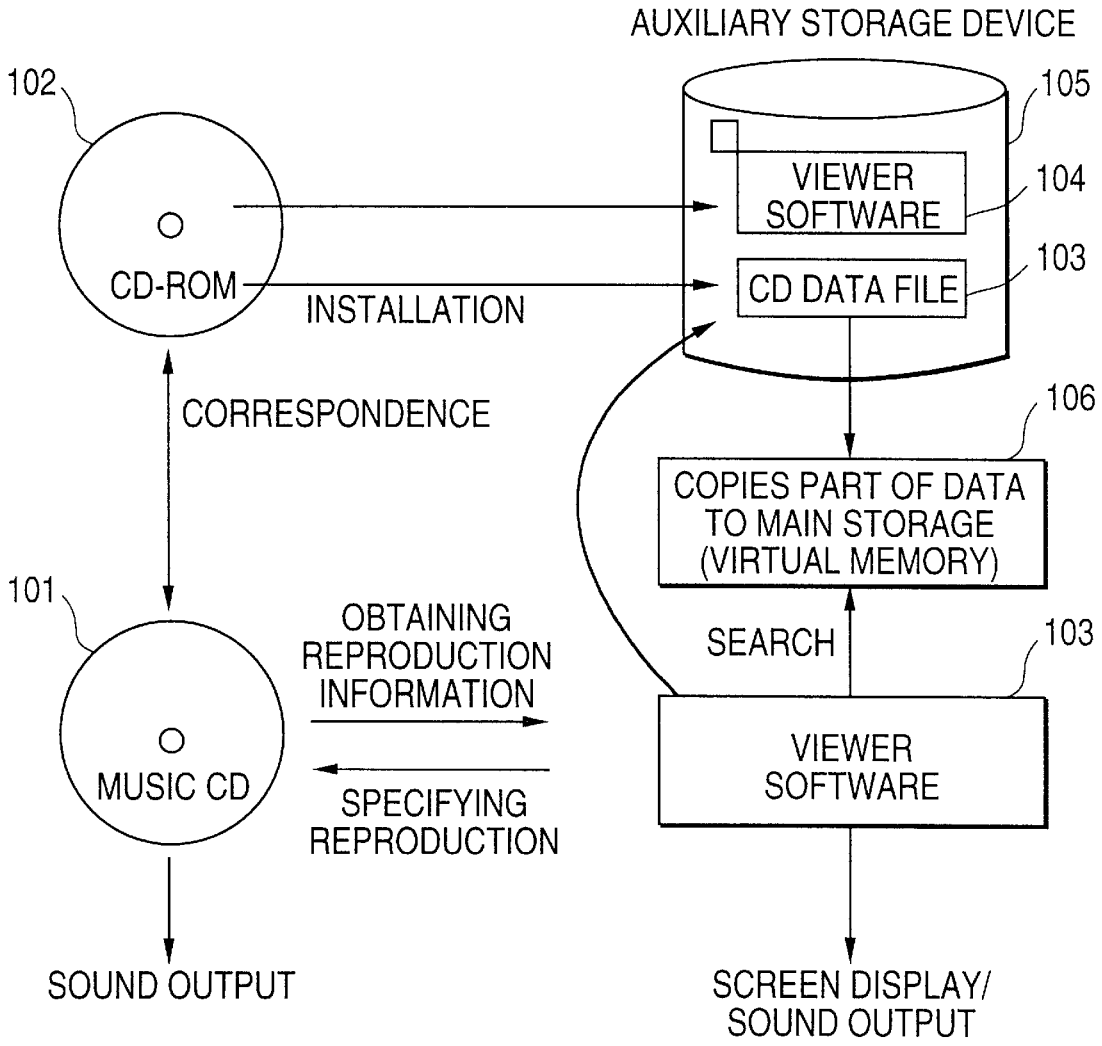
FIG. 3 shows the configuration and flow of operations of the entire karaoke system according to the third embodiment of the present invention.

FIG. 3 shows a configuration of an entire system and a flow of activities according to the third embodiment.

The karaoke system according to the third embodiment of the present invention comprises, for example, a music CD 101 storing audio information (audio data); additional information corresponding to the data stored on the music CD 101; a CD-ROM 102 storing user software; an auxiliary storage 105 storing the additional information and the viewer software respectively in a CD data file 104 and the viewer software 103 loaded from the CD-ROM 102; and a personal computer having a memory (main storage, etc.) 106 to which a portion of the additional information and the viewer software 103 are copied from the auxiliary storage 105. The above described additional information includes, for example, album information, artist information, introduction of a music piece, word synchronization information, etc., all of which are included in the music CD 101. The above described CD-ROM, for example, corresponding to a marketed music CD, is prepared in advance.

The additional information of the music CD 101 is provided in the CD-ROM 102, since it can store a large amount of data. The CD-ROM 102 storing the additional information also includes the viewer software 103 which is application software for reproducing the additional information of the music CD 101 in synchronization with reproducing the music CD 101, which will be described in detail later. Additionally, the CD-ROM 102 includes an installation program for installing the viewer software 103. Data files including the application software and the additional information for reproducing the additional information of a music piece are stored on the CD-ROM 102.

The karaoke system (audio data reproduction/display system) according to the third embodiment is implemented by the viewer software 103 and various pieces of hardware.

Figure 5:
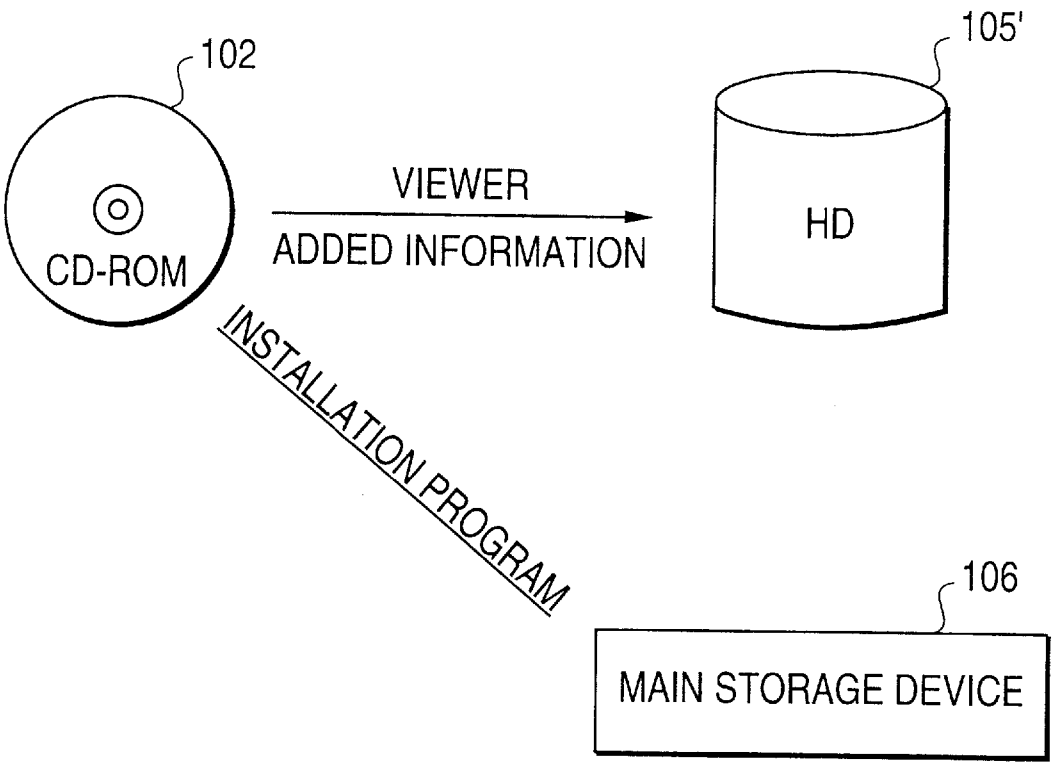
FIG. 5 shows an installation procedure.

In this embodiment, the viewer software 103 stored on the CD-ROM 102, the CD data file 104 storing the additional information of the music CD 101, etc. are downloaded to a hard disk 105' built in the auxiliary storage 105, by the installation program (See FIG. 5). The downloaded viewer software 103 controls reproduction of the music CD 101, and reproduction of the data included in the CD data file 104 (additional information). That is, in a system equipped with only one CD playback device (such as a multimedia personal computer), data stored on both the music CD 101 and the CD-ROM 102 can simultaneously be reproduced. Since all of the data for reproducing the music CD 101 are stored as files in the CD-ROM 102 as described above, a user having all pieces of hardware required for reproducing these data can easily realize the karaoke system (audio data reproduction/display system), only by purchasing the CD-ROM 102.

If the CD data file 104 is stored on a storage medium such as an MD (mini disc), etc. accessed by a driving device different from that of a CD, the above described uploading of the CD data files 104 may not need to be performed. Similarly, if the system (PC) is equipped with two or more CD driving devices, the CD data files 104 may not need to be loaded into the auxiliary storage device 105. Also, if the data stored on the music CD 101 can be anyhow loaded into the auxiliary storage device 105, the CD data files 104 may not need to be loaded.

Figure 4:
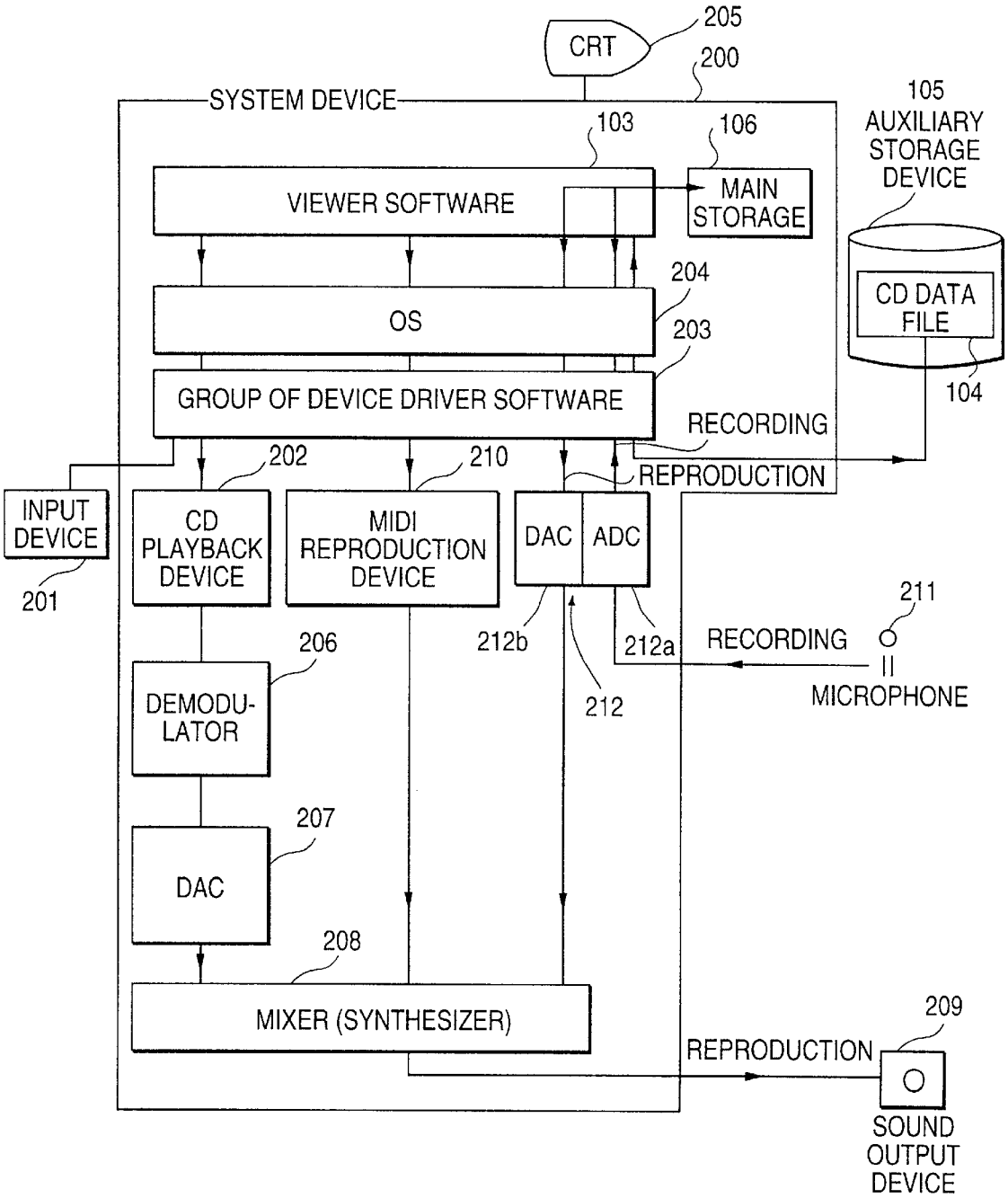
FIG. 4 is a block diagram showing the configuration of the karaoke system according to the third embodiment of the present invention.

Once the viewer software 103 stored on the auxiliary storage 105 is activated, which will be described in detail later, TOC (Table of Contents) data in a read-in area of the music CD 101 mounted in the CD playback device 202 shown in FIG. 4 is read and loaded into the main storage 106. The TOC data is, as is generally known, control data such as the number of music pieces, a recorded position of each music piece, etc. included in the music CD 101. It is equivalent to the table of contents of a book. After the TOC data is loaded into the main storage 106, the viewer software 103 makes a comparison between information obtained from the TOC data with data for identifying a music CD stored in the CD data files 104, so as to automatically identify what type of music CD the above described music CD 101 is. The viewer software 103 identifies the music CD 101, and searches for a CD data file 104 corresponding to the music CD 101. The viewer software 103 then copies the contents of the searched CD data file 104 to the main storage 106. The reason why the contents of the CD data file 104 are immediately copied to the main storage 106 when the music CD 101 is mounted in the CD playback device 202, is to display the additional information of the audio data being reproduced in synchronization with reproducing the audio data of the music CD, on a screen of a CRT 205, in real time, which will be described later, by reading the contents of the CD data file 104 from the main storage 106 to which a fast access can be made.

FIG. 4 is a block diagram showing a configuration of the karaoke system (audio data reproduction/display system) according to the third embodiment of the present invention. Explanation on the configuration and operation is provided below, referring to this figure.

A system device 200 is, for example, a personal computer (hereinafter referred to as a PC) equipped with multimedia capabilities. If a user performs a predetermined operation with an input device 201, information of the operation is transmitted from the device driver software for the input device 201 among a group of device driver software 203 to an OS 204 that interprets the information of the operation. If the information of the operation is an activation instruction of the viewer software 103, the OS 204 loads the viewer software 103 stored in the auxiliary storage 105 into the main storage 106, and activates it. The above described input device 201 comprises, for example, a pointing device (such as a mouse or a trackball) in addition to a keyboard, etc.

In a holder of the CD playback device, the music CD 101 and the CD-ROM 102 are loaded.

The activated viewer software 103 controls a controller of the CD playback device 202 (not shown in the attached drawings), and instructs a read head (not shown in the attached drawings) to read the TOC data in the read-in area of the music CD 101 mounted in the CD playback device 202, via the OS 204 and device driver software for the CD playback device 202 among the group of device driver software 203. The viewer software 103 then stores the TOC data read from the music CD 101 in the main storage 106 via the device driver software for the CD playback device 202 and the OS 204.

After the viewer software 103 stores the TOC data in the main storage 106, it generates information for identifying the music CD 101 (such as the total performance time of the CD, the total number of music pieces in the CD, the performance time of each music piece, etc.) using the TOC data. Then, the viewer software 103 reads the contents of the CD data file 104 from the auxiliary storage device 105, and searches for a CD data file 104 that matches the above described information for identifying the music CD 101, via the OS 204 and device driver software for the auxiliary storage among the group of device driver software 203. By searching for the CD data file 104 that matches the information for identifying the music CD 101, the viewer software 103 identifies the music CD 101, and recognizes a CD data name of the CD data file 104 as a CD identifier of the CD data file 104.

The viewer software 103 reads the CD data file 104 corresponding to the music CD 101 identified using the CD data name as a key, from the auxiliary storage 105, and stores the data included in the CD data file 104 in the main storage 106. The viewer software 103 then displays a portion of the data stored in the main storage 106 (such as information of an artist who created the music included in the music CD 101), on a screen of the CRT 205.

When receiving a playback instruction for the identified music CD 101 inputted from the input device 201 via the device driver software for the input device 201 and the OS 204, the viewer software 103 controls the CD playback device 202 and instructs it to play back the identified music CD 101 via the device driver software for the CD playback device. That is, the viewer software 103 controls the controller of the CD playback device 202, and instructs a read head of the CD playback device 202 to search for digital audio data interleaved and recorded from the music CD 101. The digital audio data read by the read head is de-interleaved and demodulated by a demodulator 206. After the demodulated digital audio data is converted into analog audio signals by a D/A converter (DAC) 207, they are inputted to a sound output device 209 via a mixer (synthesizer) 208. The sound output device 209 comprises, for example, a speaker, headphones, etc., and externally outputs the above described analog audio signals as acoustic sounds.

The above described additional information details album information, artist information, and information of each of the music pieces (such as an introduction of each of the music pieces, word synchronization information such as words, translation, and reading (pronunciation) of the words, of each phrase, etc.), included in the music CD 101. The CD data file 104 also includes reproduction point information (such as a phrase start time and a phrase end time), so that the reproduction point can easily be specified in phrases. In this embodiment, performance information of the karaoke version is provided as an MIDI (Musical Instrument Digital Interface) file. In this case, an accompaniment of a song is stored as MIDI information. The MIDI file includes the MIDI information conforming to the MIDI standard. The MIDI information is a message consisting of a plurality of bytes in 8-bit units. Each message consists of a status byte and a data byte that indicate a message type. The messages are classified into two major groups such as a group of channel messages and a group of system messages. The group of channel messages is further classified into a subgroup of voice messages and a subgroup of mode messages.

By transmitting these messages to a MIDI music source, a music piece can be performed in multiple channels.

The viewer software 103 reads the MIDI information from the MIDI file stored in the auxiliary storage, and transmits it to an MIDI reproduction device (MIDI music source) 210, via the OS 204 and device driver software for the MIDI reproduction device among the group of device driver software 203, and transmits it to the MIDI reproduction device (MIDI music source) 210. The MIDI reproduction device 210 generates analog audio signals according to the MIDI information, and outputs them to the mixer 208. Also for a karaoke performance according to the MIDI information (hereinafter referred to as MIDI karaoke), the reproduction point information (such as a phrase start time and a phrase end time) is provided in the CD data file 104, in order to facilitate specifying of a reproduction point in phrases. The viewer software 103 can simultaneously perform reproduction of the music CD 101 and reproduction of the MIDI karaoke and switches them, in phrases, based on the reproduction point information for the MIDI karaoke and the reproduction point information for the music CD 101.

According to this embodiment, a microphone 211 and a voice converter 212 are provided for recording/reproducing user karaoke performance. Voice waveform signals of the user karaoke performance inputted via the microphone 211 are quantized at a predetermined sampling frequency by an A/D converter within the voice converter, and then transmitted to the viewer software 103 via the device software driver for recording among the group of device driver software 203 and the OS 204. Since the sampling frequency is predetermined, the viewer software 103 stores only the voice waveform data, quantized into a predetermined number of bits and inputted, in the main storage 106 after they are encoded using the PCM method. In this case, high efficiency coding methods such as the ADPCM method, MPEG method, etc. may be used to compress and store data. Even if these high efficiency coding methods are used, the amount of the voice waveform data becomes huge. Therefore, the voice waveform data may be stored in phrases in the auxiliary storage device 105 at any time.

As described above, the recorded data of the karaoke performance by being encoded by a variety of methods, can be reproduced by the viewer software 103. In this case, after reading the recorded data from the main storage 106 and decoding it depending on need, the viewer software 103 transmits the digital voice waveform data to the D/A converter (DAC) 212*b* within the voice converter 212, via the device driver software for reproduction among the group of device driver software 203. The DAC 212*b* converts the digital voice waveform data into the analog voice waveform signals, and outputs them to the mixer 208.

Recording and reproducing the user karaoke performance do not merely record and reproduce the performance. They can be performed in synchronization with reproducing the music CD 101. According to the present invention, since the amount of recorded data becomes huge, a recording duration of the performance is defined to be up to 2 phrases, so as to synchronize each phrase. This synchronization is implemented by identifying the reproduction point of the music CD 101 according to the above described reproduction point information, and by recording or reproducing the user performance in synchronization with reproducing the phrases.

The mixer 208 can mix three types of audio data, and output to the sound output device 209. Thus, a synchronous reproduction (a synchronous performance) or a switching reproduction between the music CD 101 and the MIDI karaoke, can be performed. The synchronous reproduction and the switching reproduction may also be performed in phrases. Furthermore, the synchronous reproduction and the switching reproduction between the music CD 101 and the user karaoke performance may be performed.

The following capabilities are implemented by the viewer software 103.

When synchronously reproducing the music CD 101 and the MIDI karaoke, for example, the viewer software 103 initially instructs the CD playback device 202 to start playing back the music CD 101. Then, the viewer software 103 monitors the digital audio data started to be outputted from the demodulator 206, for example, after the CD playback device 202 finishes it's seek operation, and controls the data of the MIDI karaoke reproduced by the MIDI reproduction device 210 so as to be inputted to the mixer 208 in synchronization with the audio data of the music CD 101 outputted from the DAC 207. Thus, the music CD 101 and the MIDI karaoke are synchronized and reproduced. If the words display mode is specified in this case, which will be described in detail later, the viewer software 103 instructs the CRT 205 to display the words of a music piece being played back on a screen, and informs the progress status of the music piece to the user by highlighting the phrase being played back.

Additionally, the viewer software 103 controls the audio data of the music CD 101 and the reproduction data of the user karaoke performance outputted from the DAC 212*b*, so that they can be synchronized and inputted to the mixer 208, in a similar manner as in the above described case. Thus, the music CD 101 and the user karaoke performance are synchronously reproduced. The viewer software 103 also instructs the CRT 205 to display the words of the music piece being played back included in the music CD 101 on the screen, in a similar manner as in the above described case.

Furthermore, the viewer software 103 switches between the reproduction of the music CD 101 and the reproduction of the user karaoke performance, for example, according to an instruction of switching music sources given by the user via the input unit 201. That is, these reproductions are switched by switching a reproduction target via an input of the above described instruction of switching music sources as an event from the device driver software for the input device.

In the meantime, by controlling the mixer 208, the music CD 101, the MIDI karaoke, and the user karaoke performance may be reproduced in various forms, depending on a type of the sound output device 209. For example, if stereo headphones are used as the sound output device 209, the reproduced sounds of both the music CD 101 and the user karaoke performance can not only be outputted as synthesized sounds via the right and left headphones by performing a sound synthesis, but respectively outputted as reproduced sounds of the music CD 101 via the right headphone, and reproduced sounds of the user karaoke performance via the left headphone. In the latter case, the user can easily listen to the respective reproduced sounds, and make a comparison between them. Accordingly, the user can easily identify his or her own singing capabilities and weak points. It is therefore very effective for practicing karaoke.

The above description is a summary of the control operations of the viewer software 103.

Provided below is an explanation of a file downloaded from the CD-ROM 102 to the auxiliary storage 105 by the above described installation program.

Figure 6:
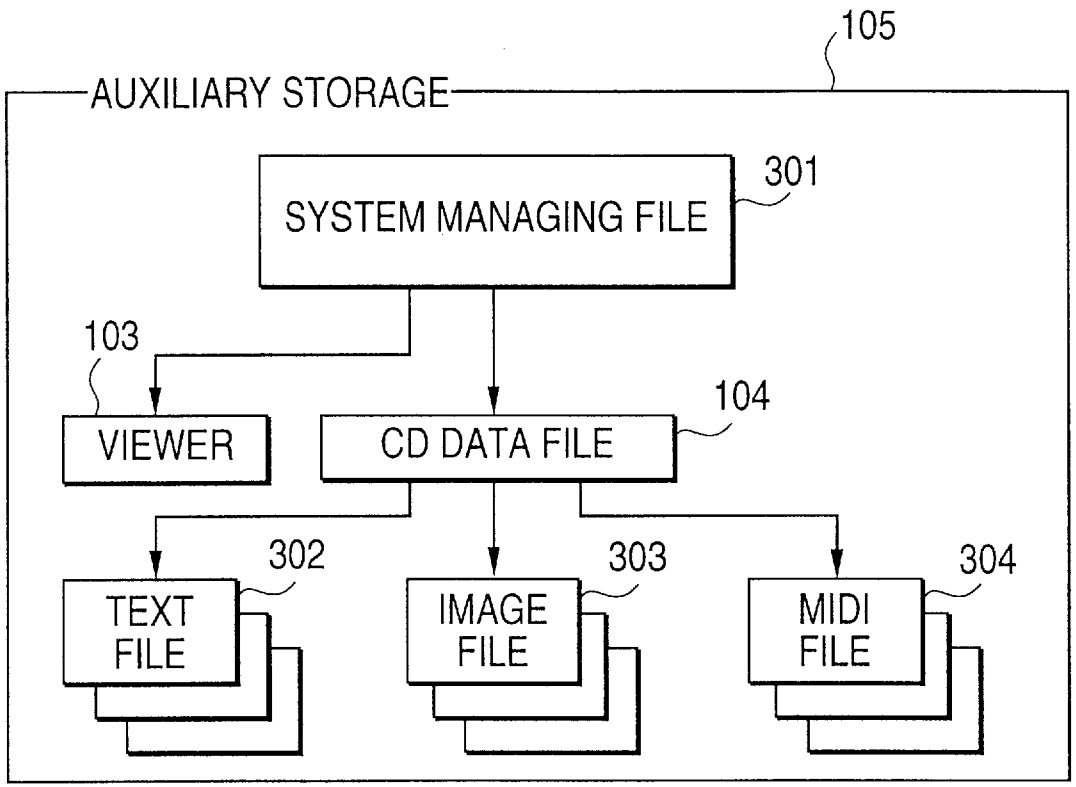
FIG. 6 shows a file management structure according to the third embodiment of the present invention.

When activated in a state that the CD-ROM 102 is mounted in the CD playback device 202, the installation program stores various types of files included in the CD-ROM 102 onto the hard disk 105' built in the auxiliary storage 105 (See FIG. 5.). FIG. 6 is a block diagram showing a structure of managing the various types of files included in the auxiliary storage 105.

As shown in FIG. 6, the auxiliary storage 105 is loaded with a system management file 301, a text file 302, an image file 303, and a MIDI file 304, in addition to the above described viewer software 103 and CD data file 104 from the CD-ROM 102. Furthermore, an uninstallation program (not shown in the attached drawings) is stored in the auxiliary storage device 105 by the installation program in addition to the above listed files. Thus, the CD-ROM 102 stores various files as a set of a database.

The system management file 301 is stored by the installation program in a specific area in the auxiliary storage device 105. The system management file 301 corresponds to a root directory of the various files loaded in the auxiliary storage 105 from the CD-ROM 102, and stores the management information about the files storing the viewer software 103 and various files in the CD data file 104.

Figure 7:
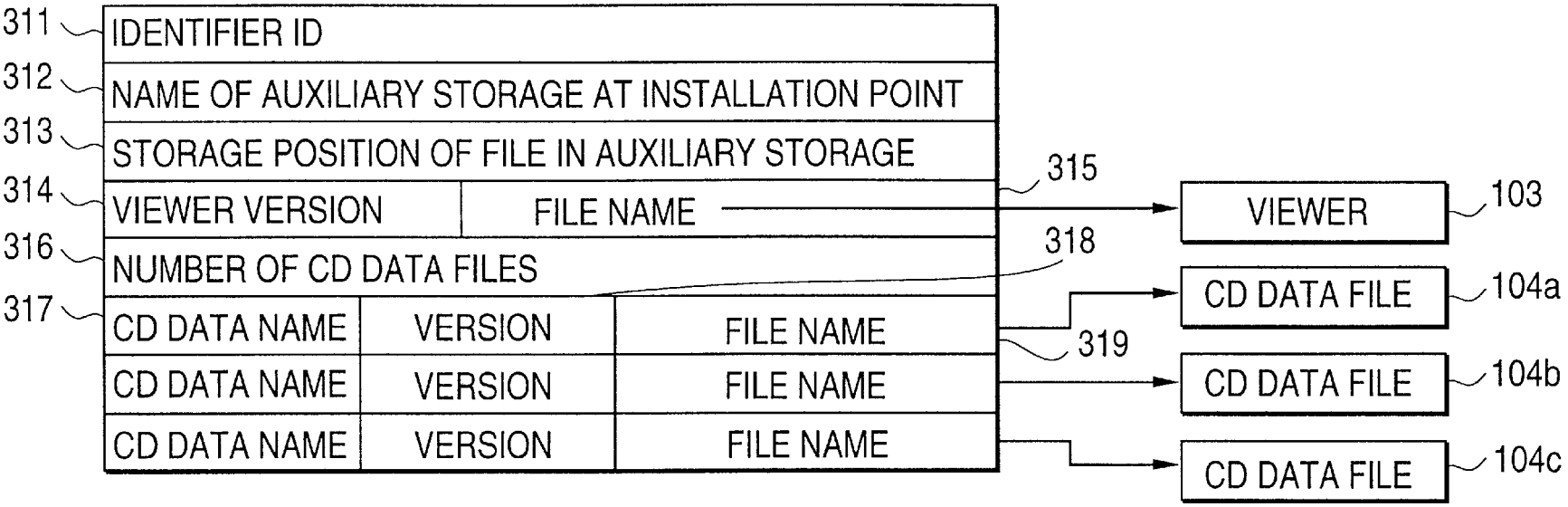
FIG. 7 shows a structure of a system management file according to the third embodiment of the present invention.

FIG. 7 shows a data structure of the system management file 301.

An identifier 311 is used when the viewer software 103 identifies the system management file 301. The name 312 of an auxiliary storage at the installation point is the name of the auxiliary storage 105 in which the viewer software 103 and CD data file 104 are installed. The storage position information 313 of the file in the auxiliary storage 105 refers to a name of a directory to which the viewer software 103 and CD data file 104 belong, and is required when the file storage position in the auxiliary storage device 105 is obtained.

Version information 314 of the viewer software 103 refers to a version number of the viewer software 103. A file name 315 of the viewer software 103 refers to a name of the file containing the viewer software 103, that is, the information indicating the storage position. Since the viewer software 103 may be updated, the version number of the viewer software 103 is stored as version information 314.

According to the present embodiment, a plurality of CD data files 104 can be registered in the auxiliary storage device 105. CD data volume information 316 refers to the total number of the CD data files 104 registered in the auxiliary storage 105.

The CD data volume information 316 is followed by a CD data name 317, a version number 318, and a file name 319 to be stored for all CD data files 104 registered in the auxiliary storage device 105. The CD data name 317 refers to a name assigned to each CD data file 104. The version number 318 refers to a version number of the CD data file 104 which may also be updated. The file name 319 refers to the storage position of the CD data file 104 having the above described CD data name 317.

The viewer software 103 reads a target CD data file 104 from the auxiliary storage 105 according to the name 312 of the auxiliary storage at the installation point, the storage position information 313 of the file in the auxiliary storage 105, and the file name 319 of the CD data file 104.

When the CD-ROM 102 loaded with the viewer software 103 of a new version is mounted in the CD playback device 202, the contents of the system management file 301 are rewritten by the installation program in the CD-ROM 102. That is, the version information 314 of the viewer software 103, the file name 315 of the viewer software 103, the CD data volume information 316, etc. are updated, and the CD data name 317, the version number 318, and the file name 319 of the new CD data file 104 are added.

Thus, each time the CD playback device 202 is loaded with the CD-ROM 102 storing a new version of the viewer software 103, the viewer software 103 is updated and the new CD data file 104 is added.

FIG. 7 shows the state in which the installation is performed three times by the installation program stored on the three variations of CD-ROM 102. The three CD data files 104*a* through 104*c* shown in FIG. 7 refer to different CD data names 317. The viewer software 103 can use the CD data file 104 of a version older than its own version. These three CD data files 104*a* through 104*c* are integrated and managed as a set of a database using the system management file 301. The installation program loads only the CD data file 104 having a different CD data name 317 of the latest version number 318 into the auxiliary storage device 105 by referring to the CD data name 317 in the system management file 301 and the version number 318 of the CD data file 104, and then adds the file to the database. When a CD data file 104 is added, the CD data volume information 316 is simultaneously updated.

The installation program references the version information 314 of the viewer software 103 in the system management file 301 and the file name 315 of the viewer software 103 to update the viewer software 103. That is, if the viewer software 103, having a version number older than the version number of the viewer software 103 in the CD-ROM 102 storing the installation program, is stored in the auxiliary storage 105, then the viewer software 103 of a version newer than that stored on the CD-ROM 102 is stored in the auxiliary storage 105 so that the version information 314 of the viewer software 103 of the system management file 301 is updated to the new version number. If the file name (storage position) of the newly loaded viewer software 103 is different from that of the older version, then the file name 315 is also updated to a new file name.

FIG. 8 shows the contents of the CD data file 104.

The CD data file 104 stores CD information 330 shown in FIG. 8A; artist information 340 shown in FIG. 8B; and music information 350 shown in FIG. 8C. The information 330 through 350 is represented by the data consisting of a plurality of items and stores the storage position information, as the file name 315, for the text file 302, the image file 303, or the MIDI file 304, depending on the type of the information.

The CD information 330 stores the file names 315 of the jacket photo files of the music CDs 101 stored as CD photo information 335, that is, the image files 303, and the file names 315 of the album information files stored as CD album information 336, that is, the text files 302.

The artist information 340 stores the file names 315 of the artist information files stored as artist information 343, that is, the text file 302, and the file names 315 of the artist photo files stored as photo information 344, that is, the image file 303. Furthermore, the music piece information 350 stores the word file and the MIDI file 304 as word information 358 and MIDI information 359 respectively.

The CD information 330 stores the total performance time and total number of music pieces stored on the music CD 101 as CD total performance time information 337 and CD music piece number information 338 respectively. The music piece information 350 is provided for each music piece recorded on the music CD 101, and the performance time of each music piece is stored as performance time 357.

As described above, the viewer software 103 and CD data file 104 are managed in the auxiliary storage 105 by the system management file 301. The CD data file 104 builds the database in a hierarchical structure in which the text file 302, image file 303, and MIDI file 304 are managed. The CD data file 104 consists of a plurality of text files 302, image files 303, and MIDI files 304.

The viewer software 103 reads the CD data file 104 by referencing the system management file 301, and reads the text file 302, the image file 303, and the MIDI file 304, by referencing the CD data file 104.

The contents of the CD data file 104, text file 302, and image file 303 are selected and displayed depending on each mode.

The present embodiment presents an artist information display mode, a word display mode, a music information display mode, and a discography mode, as the modes in which display items are specified. Each of the contents of the CD data file 104, the text file 302, and the image file 303 are read from the auxiliary storage 105 depending on each of the modes, and displayed on a screen of the CRT 205.

Figure 9:
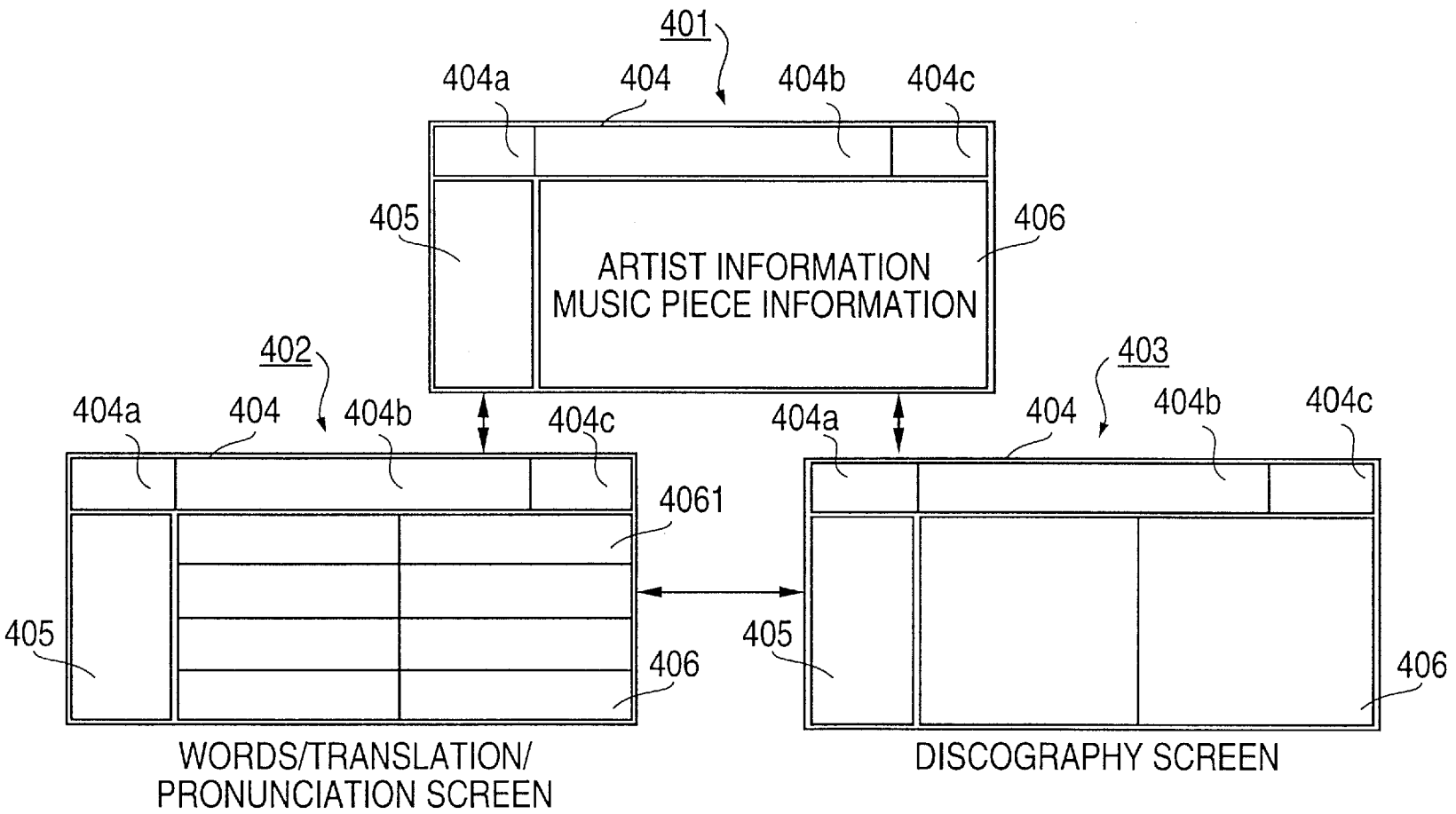
FIG. 9 shows a state of a display screen in a mode transition or in each mode according to the third embodiment of the present invention.

FIG. 9 shows the state of the display screen in each of the above listed modes and in the transition between the modes. In FIG. 9, a display screen 401 corresponds to the artist information display mode and the music information display mode. A display screen 402 corresponds to the word display mode, and a display screen 403 corresponds to the discography mode.

Each of the above described display screens 401 through 403 is formed by three areas, that is, a command area 404 positioned at the top; a selection list area 405 positioned on the left; and an information area 406 other than those areas.

The command area 404 is formed by a title display box 404*a* in which the title of the music CD 101, the title of the music piece being played back, etc. are displayed; a CD operation box 404*b* in which the operation buttons for the music CD 101 such as playback, stop, fast-forwarding, rewinding, etc. are displayed; and a mode setting box 404*c* in which various mode setting buttons are displayed. According to the present embodiment, clicking the setting button for each mode in the mode setting box 404*c* by a pointing device such as a mouse which is the input device 201, switches the current mode to the mode assigned to the clicked button.

The selection list area 405 is a selection list box in which a list of the music pieces stored on the music CD 101 is displayed. The user can specify the playback of music by selecting by clicking with the mouse after moving the mouse cursor to the corresponding item displayed on the list. The selection list area 405 displays not only a list of the music pieces stored on the music CD 101 but also all the music pieces by a specified artist, for example.

The information area 406 displays a general purpose information display area in which words, translation, the pronunciation of the translation (hereinafter referred to as the word information (data)) are displayed when, for example, the word display mode is set. In the word display mode, the information area 406 is divided into a plurality of word areas 4061 (8 areas in FIG. 9) to display the word information in each word area 4061.

Figure 10:
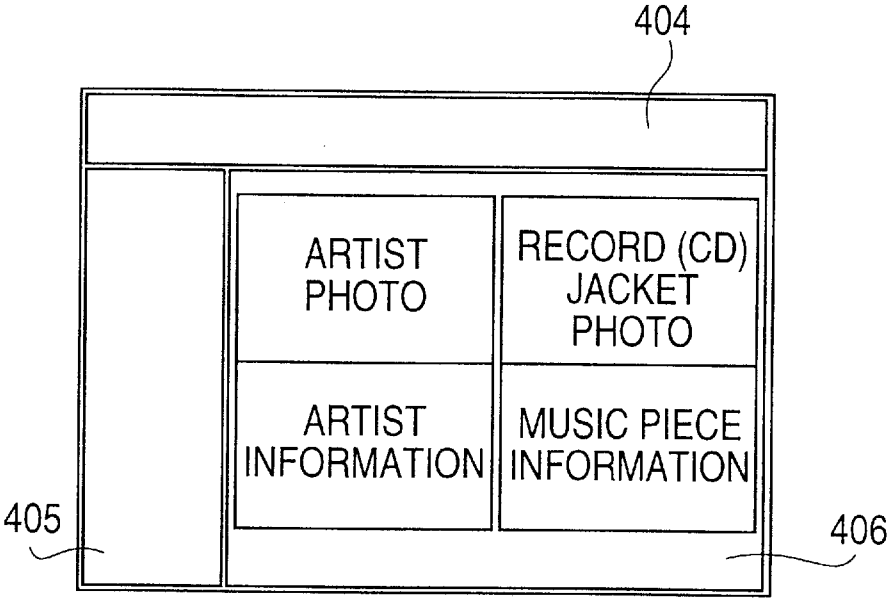
FIG. 10 shows a display format of artist and music information.

FIG. 10 shows the display format of the data displayed in the artist information display mode and the music information display mode. In these modes, the following data is displayed in the information area 406.

| Artist Information / Music Information Mode | |
|---|---|
| Artist Information | |
| Name of the Artist | Agent to which the artist belongs |
| Picture of the Artist | Gender |
| Explanation about the Artist | Birthday/Blood Type |
| Music Piece Information | |
| Title of the Music Album | Copyright |
| Original Publisher | Sub-publisher |
| Jacket Photo | Explanation of the Music |
| Composer | Song Writer |
| Arranger | |
| Record Company | Type of Record (CD) |
| Number of the Record Company | Label |
| Release Date | Price |
| Current / Deleted | |

A foreign artist is described with "the name of the artist", "title of the music", "title of the album", and "list of the contents of the album" in both original and translated-into languages, or in either of the two.

Figure 11A:
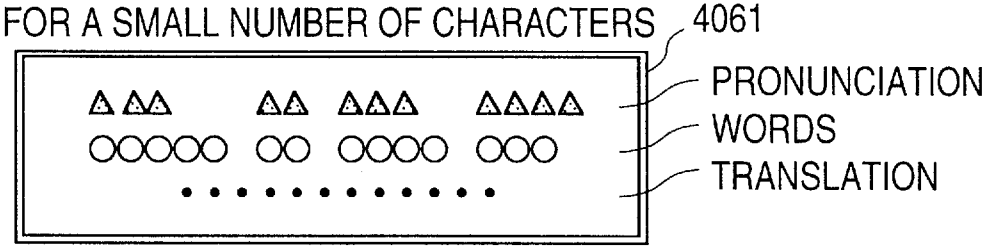
FIGS. 11A and 11B show the display format of words displayed in a word area.
Figure 11B:
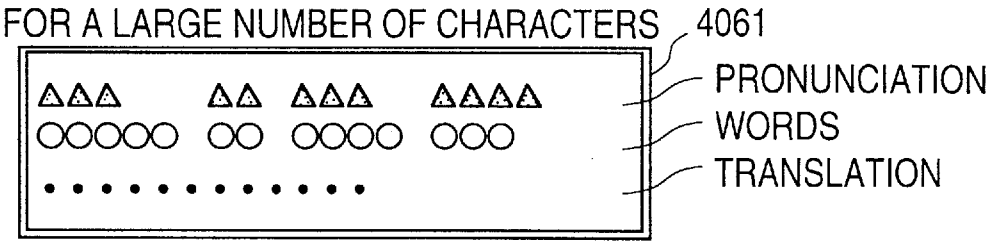

FIG. 11 shows the display format of the word information displayed in the word area 4061 in the word display mode. The word information is centrally displayed in the word area 4061 as shown in FIG. 11A when a small number of characters are displayed. If a large number of characters are displayed, they are left-aligned as shown in FIG. 11B. so that the largest possible number of characters can be displayed in the word area 4061. The word information consists of words, translation, and pronunciation of the translated words. The user can select any desired displayed item from the word information by, for example, clicking a predetermined button (not shown in the attached drawings) in the command area 404.

Figure 12:
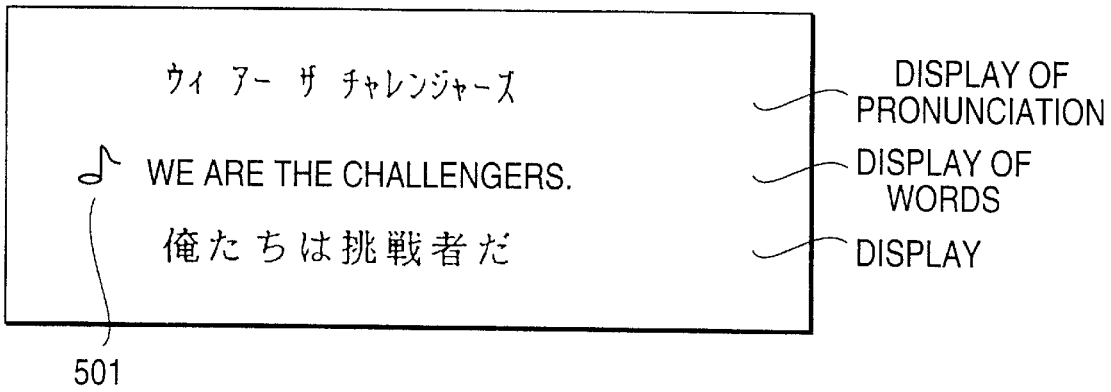
FIG. 12 shows an example of a display in the word area.
Figure 13:
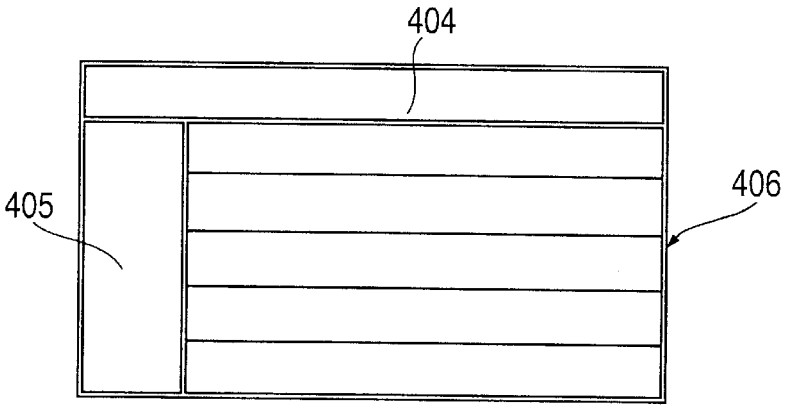
FIG. 13 shows another display format in the word display mode.

FIG. 12 shows an example of a display in the word area 4061. In this figure, the switch button 501 displayed on the left of the word area 4061 is used to specify the performance data for reproducing the phrase displayed on the screen while executing a reproduction point changing process, to be described later. FIG. 13 shows another display format in the word display mode. The data displayed in the word display mode are listed below.

| Word/Translation/Pronunciation Display Mode | | |
|---|---|---|
| Artist Information | | |
| Name of the Artist | | |
| Music Piece Information | | |
| Title of the Music Album | | Copyright |
| Original Publisher | | Subpublisher |
| Composer | | Song Writer |
| Arranger | | |
| Words | Pronunciation | Translation |

A foreign artist is described with "the name of the artist", "title of the music", "title of the album", and "list of the contents of the album" in both original and translated-into languages, or in either of the two.

Figure 14:
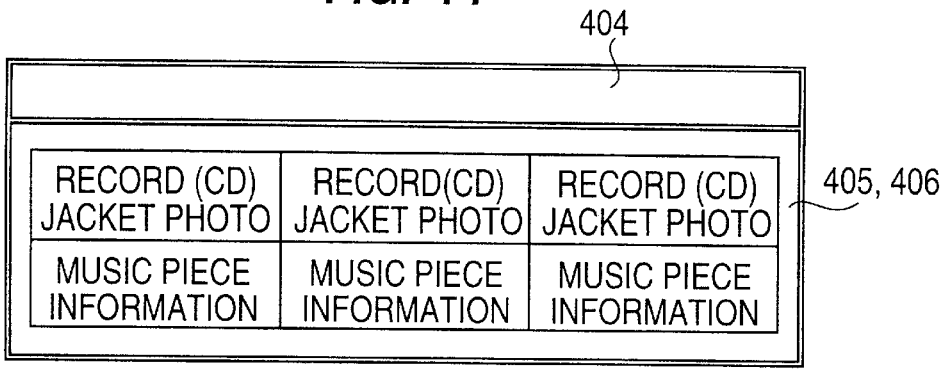
FIG. 14 shows displayed data and a display format in a discography mode.

FIG. 14 shows one of the display formats of the data to be displayed in the discography mode. In the format shown in FIG. 14, the selection list area 405 as well as the information area 406 is used as a data display area. The data displayed in this mode are listed below.

| Discography Mode | |
|---|---|
| Artist Information | |
| Name of the Artist | |
| Album Information | |
| Name of the Album | List of Music Pieces in the Album |
| Jacket Photo | Copyright |
| Original Publisher | Subpublisher |
| Record Company | Type of Record (CD) |
| Number of the Record Company | Label |
| Record Company | Price |
| Release Date | |
| Current / deleted | |

A foreign artist is described with "the name of the artist", "title of the music", "title of the album", and "list of the contents of the album" in both original and translated-into languages, or in either of the two.

FIG. 15 shows examples of the data displayed in the selection area 405 and the information area 406.

As shown in this figure, the user can easily obtain various information about the music pieces included in the music CD 101 from the display of the CRT 205, by being provided with the CD-ROM 102 where the data of the music pieces included in the music CD 101 and the viewer software 103 for searching for that data are stored.

Figure 16:
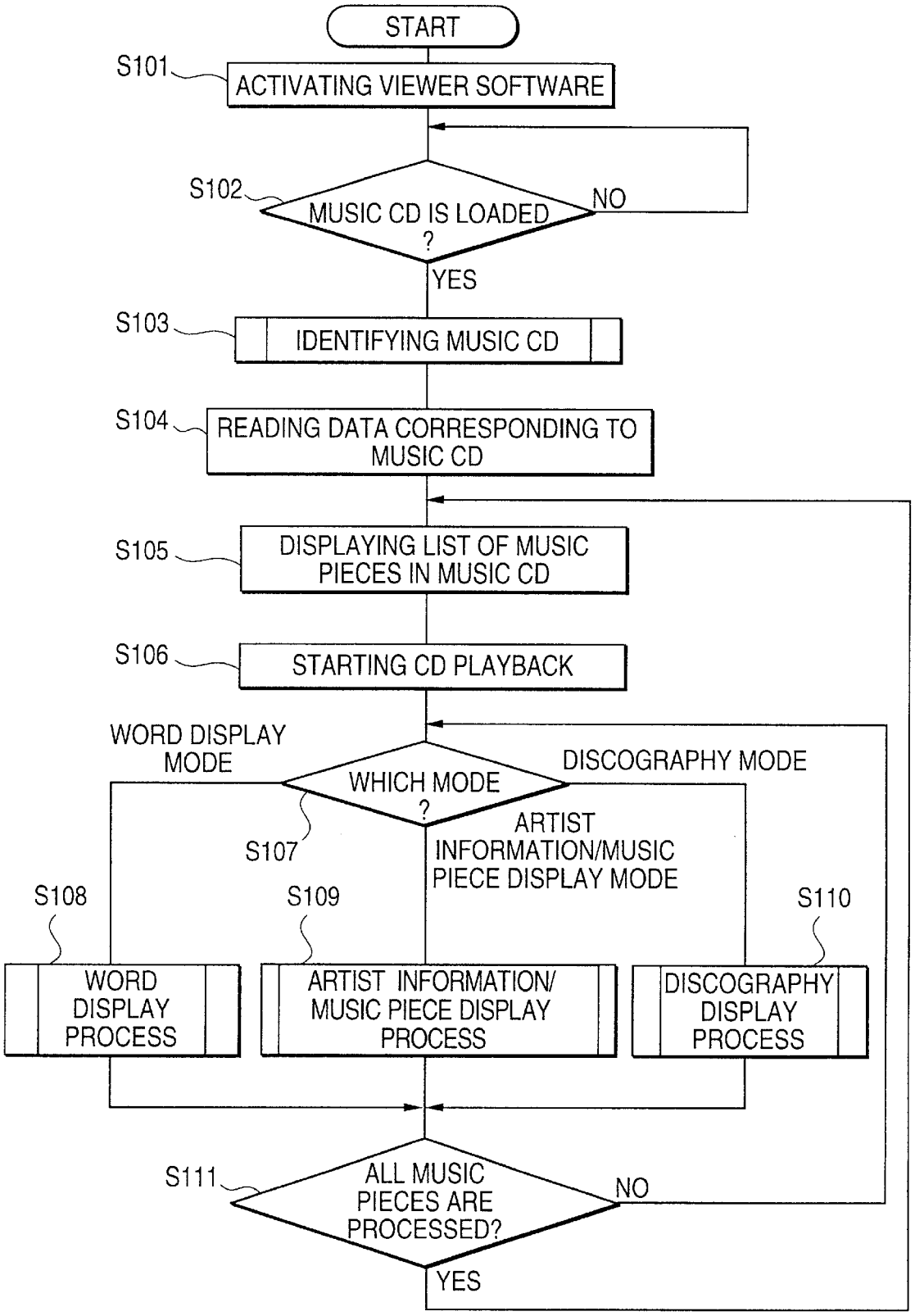
FIG. 16 is a flowchart showing the activation process according to the third embodiment of the present invention.

Next, the operations of the viewer software 103 are described in detail by referring to FIG. 16 FIG. 16 is a flowchart showing the operation of the system according to an embodiment of the present invention. The entire operation of the viewer software 103 is explained below by referring to the flowchart shown in FIG. 16.

The viewer software 103 stored in the auxiliary storage device 105 is activated after being loaded by the OS 204 from the auxiliary storage device 105 into a specified area in the main storage device 106 (shown in FIG. 5) by, for example, inputting a predetermined command from the input device 201 or clicking a predetermined icon displayed on the screen of the CRT 205 (S101). The activated viewer software 103 determines, via the device driver software for the CD playback device, whether or not the music CD 101 has been mounted in the CD playback device 202 (S102). The viewer software 103 repeats this determination until the music CD 101 is mounted in the CD playback device 202. While the determination is repeatedly made, a message prompting to mount the music CD 101 is displayed on the CRT 205.

When the music CD 101 is mounted in the CD playback device 202, the viewer software 103 identifies it via the device driver software for the CD playback device, and starts the process in step S103.

In step S103, the viewer software 103 reads the TOC data on the music CD 101 mounted in the CD playback device 202 via the device driver software for the CD playback device, and stores the data in the main storage device 106. Then, it extracts each piece of data, that is, the total performance time, total number of music pieces, and performance time of each music piece, from the TOC data stored in the main storage 106. The viewer software 103 then compares the data with the identification information used in identifying the music CD 101 sequentially read from the CD data file 104 through the device driver software, and identifies the type of the music CD 101 loaded in the CD playback device 202 (S103).

Figure 17:
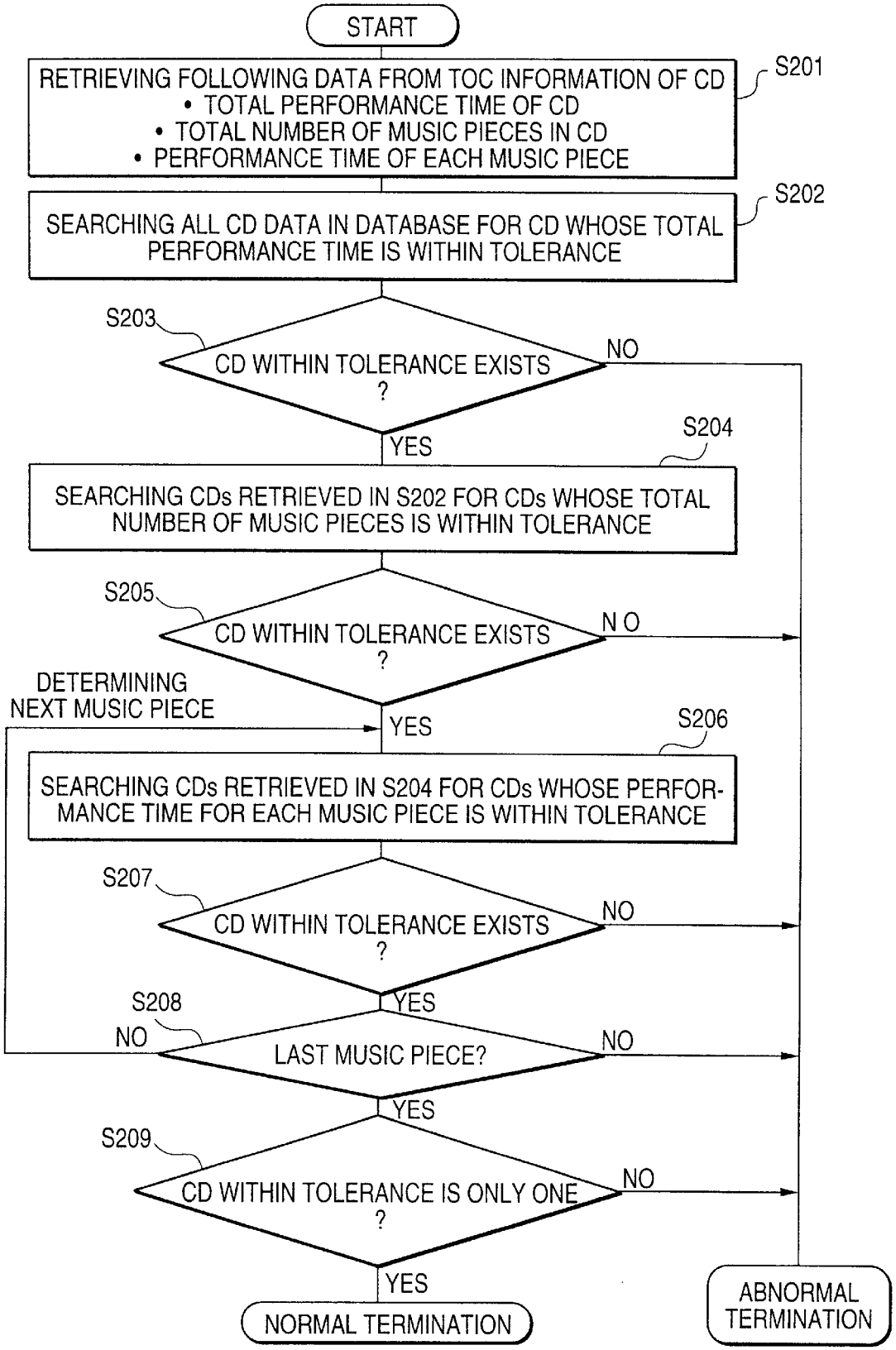
FIG. 17 is a flowchart showing a music CD identifying process according to the third embodiment of the present invention.

The identifying process performed for the music CD 101 in step 103 is described in detail by referring to the flowchart shown in FIG. 17.

In this process, the total performance time, total number of music pieces, and performance time of each music piece are extracted from the TOC data stored in the main storage device 106. The information is defined as key data (S201).

Then, a data file matching the above described mounted music CD 101 in total performance time within a tolerance is searched for among all CD data files 104 stored as a set of a database (S202). In this search, the CD total performance time information 337 (see in FIG. 8A) classified in the CD information 330 is read from each of the CD data files 104 of all CD data names 317 registered in the system management file 301 as shown in FIG. 7. The read value is compared with the total performance time of the music CD 101. After the search, it is determined whether or not there is any CD data file 104 (CD data name 317) matching the music CD 101 in the total performance time within the tolerance (S203). The tolerance is, for example, ±1 second.

If "NO", that is, if it is determined in step S203 that there is no CD data file 104 (CD data name 317) matching the music CD 101 in the total performance time within the tolerance, then this determination is displayed on the screen of the CRT 205 and the process terminates. In this case, for example, the message is displayed on the screen of the CRT 205 to prompt the user to mount another music CD 101, until another music CD 101 is mounted in the CD playback device 202 (abnormal termination).

If "YES", that is, if it is determined in step S203 that there is a CD data file 104 (CD data name 317) matching the music CD 101 in the total performance time within the tolerance, then the CD data file 104 (CD data name 317) matching the music CD 101 in the total number of music pieces is searched for in the determined CD data file 104 (S204), and then it is determined whether or not there is any CD data file 104 (CD data name 317) matching the music CD 101 in the total number of music pieces (S205). In the search in step S204, the CD music piece number information 338 (see in FIG. 8A) classified in the CD information 330 is read from each of the CD data files 104. The read value is compared with the total number of music pieces of the music CD 101.

If "NO", that is, if it is determined in step S205 that there is no CD data file 104 (CD data name 317) matching the music CD 101 in the total number of music pieces, then the result of this determination is displayed on the screen of the CRT 205 and the process terminates. In this case, for example, the message is displayed on the screen of the CRT 205 to prompt the user to mount another music CD 101 until another music CD 101 is mounted in the CD playback device 202 (abnormal termination).

If "YES", that is, if it is determined in step S205 that there is a CD data file 104 (CD data name 317) matching the music CD 101 in the total number of music pieces, then the CD data file 104 (CD data name 317) matching the music CD 101 in the performance time of each music piece within a tolerance (for example, ±1 second) is searched for in the determined CD data file 104 (S206), and then it is determined whether or not there is any CD data file 104 (CD data name 317) matching the music CD 101 in the performance time of each music piece within the tolerance (S207). The music piece information 350 about the CD data file 104 is given for each music piece, and the performance time is stored as a part of the performance time 357. In the search in step S206, the performance time of each music piece in each of the CD data files 104 is compared with the same number music piece in the music CD 101.

If "NO", that is, if it is determined in step S207 that there is no CD data file 104 (CD data name 317) matching the music CD 101, then this determination is displayed on the screen of the CRT 205 and the process terminates. In this case, for example, the message is displayed on the screen of the CRT 205 to prompt the user to mount another music CD 101 until another music CD 101 is mounted in the CD playback device 202 (abnormal termination).

If "YES", that is, if it is determined in step S207 that there is a CD data file 104 (CD data name 317) matching the music CD 101, then it is determined whether or not the currently retrieved music piece is the last music piece of the music CD 101, that is, it is determined whether or not the comparison has been completed for all music pieces (S208). If the music piece being searched is not the last music piece ("NO" in S208), control is returned to step S206, and the processes in steps S206 through S207 are performed on the next music piece.

Thus, the CD data file 104 (CD data name 317) matching the music CD 101 in the performance time of all music pieces within tolerance is searched for. That is, all the CD data files 104 (CD data name 317) matching the music CD 101 in the performance time of all music pieces within an allowable tolerance are retrieved by repeating the processes in steps S206 through S208.

If the determination is completed on all CD data files 104 (CD data name 317) in step S208 as to whether or not they match the music CD 101 in the performance time of all music pieces ("YES" in S208), then it is determined whether or not there is only one CD data file 104 (CD data name 317) matching the music CD 101 in the total performance time (S209). If there are two or more CD data files 104 (CD data names 317) ("NO" in S209), then the user is notified of the determination and the process terminates. In this case, the message is displayed on the screen of the CRT 205 to prompt the user to mount another music CD 101, until another music CD 101 is mounted in the CD playback device 202 (abnormal termination).

If it is determined that there is only one CD data file 104 (CD data name 317) matching the music CD 101 in the performance time of each music piece within the tolerance in step S209 ("YES" in S209), the CD data name 317 of the CD data file 104 is stored in the main storage device 106 as an identifier for use in accessing the CD data file 104 corresponding to the identified music CD 101, and the process terminates (normal termination). In this case, the process in step S104 is performed as shown in FIG. 16.

It is rare that one music CD 101 matches another music CD exactly in the total number of music pieces, total performance time, and performance time of each music piece, within the tolerances. Such matching probability is very low. Therefore, according to the process shown by the flowchart in FIG. 17, the music CD 101 mounted in the CD playback device 202 can be exactly identified.

For the reasons of the manufacturing management and technology, the music CD 101 is not uniform in the storage state of music, that is, audio data. The degree of non-uniformity may depend on the manufacturers (factories, etc.). This non-uniformity prevents the music CD 101 from being exactly identified when determining whether or not the music CD 101 matches another CD in the total performance time and the performance time of each music piece. Actually, many music Cds 101 cannot be exactly identified. However, the present embodiment can determine a match if the comparison data indicates tolerances when searching for the CD data file 104 (CD data name 317), matching the music CD 101 in the total performance time and the performance time of each music piece. Therefore, the above described problem can be avoided and the music CD 101 can be correctly identified when compared with the CD data files 104.

The processes in and after step S104 are described below by referring to FIG. 16.

When the process in step S103 is performed as described above and the music CD 101 mounted in the CD playback device 202 is identified, the additional information (data) for the music CD 101 is read from the CD data file 104 according to the identification result (CD data name 317 shown in FIG. 7) and loaded into the main storage 106 (S104).

Since the music CD 101 mounted in the CD playback device 202 can be identified as described above, the related additional information can be initially prepared in the main storage 106. Therefore, it is not necessary for the user to select additional information corresponding to the music CD 101. Thus, the load on the user can be reduced with the system operability improved.

According to the present embodiment, data is written to the main storage 106 and then each process is performed in default order to further reduce the operation load of the user (unless the user operates a specific mode setting button or any user operation button for the CD).

Then, a list of the music pieces stored on the music CD 101 is displayed on the screen of the CRT 205 according to the music information 350 of each music piece loaded into the main storage 106 (S105), and the music CD 101 is played back (S106).

Music is played back after being selected via the input device 201 from among the music pieces on the list displayed on the screen of the CRT 205. The viewer software 103 identifies the music CD 101 mounted in the CD playback device 202, and displays the CD information 330 for a predetermined period in the information area 406. When a music piece to be played is selected, including starting playing from the first music piece, the information about this music piece to be played next is displayed in the information area 406, until this music piece is played, upon selection of the music piece to be played.

The music CD 101 is played back when the viewer software 103 sends a control command to the CD playback device 202 via the OS 204 and device driver software for the CD playback device. After the viewer software 103 sends the control command (seek instruction), the start of the playback of the music CD 101 is monitored by inquiring of the controller (not shown in attached drawings) of the CD playback device 202 as to whether or not the music CD 101 has been played back.

When the music is selected as described above, the mode currently selected is determined in step S107. According to the present embodiment, the mode is determined from among the word display mode, artist information /music piece information display mode, and discography mode, depending on the contents displayed on the CRT 205. In the mode determination in step S107, the current mode is determined from among the word display mode, artist display/music information display mode, and discography mode.

Figure 18:
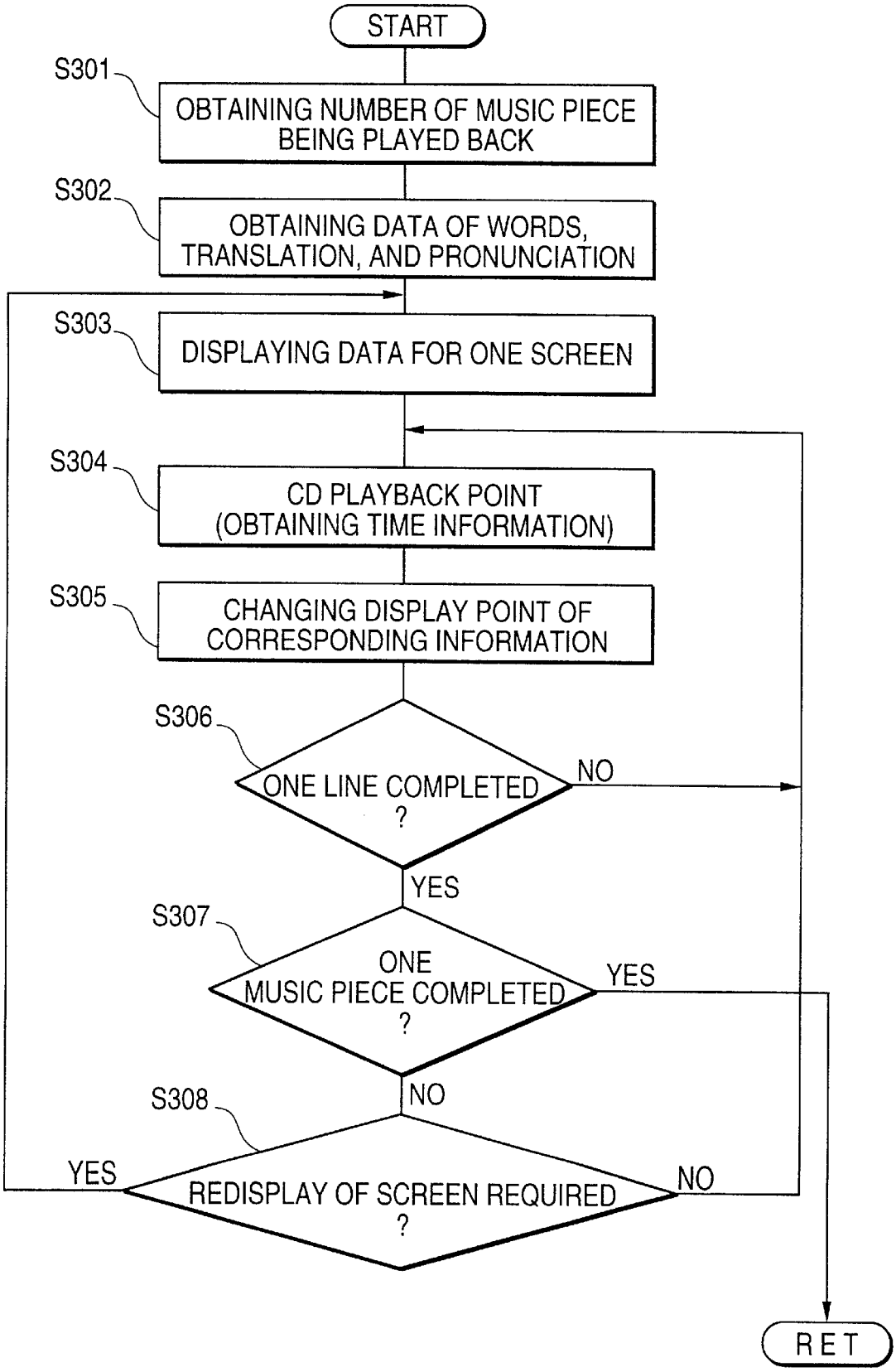
FIG. 18 is a flowchart showing a word display process according to the third embodiment of the present invention.

If it is determined in step S107 that the word display mode is entered, a word display process is performed next (S108). FIG. 18 is a flowchart showing the word display process. The word display process is explained below by referring to FIG. 18.

In the word display process, the number of the music piece set after the entire process shown in FIG. 16, and currently being played, is obtained (S301).

Then, the word data (words, translation, and pronunciation) of the music piece information 350 corresponding to the obtained number of the music piece is acquired from the additional information read from the CD data file 104 corresponding to the music CD 101 currently being played back (S302). The word data is stored in a file having a word file name 358, that is, one of the items of the music piece information 350 in the CD data file 104 (see in FIG. 8C). The word data stored in the word file (text file) contains words, translation, and pronunciation when the words are written in a foreign language, and contains words and pronunciation if the words are written in Japanese.

When the above described word data is acquired, the data is displayed for one screen in synchronization with the portion of the music piece currently being played (S303). Then, the current playback point of the music CD 101, that is, the time from the start of playing of the music piece (reproduction elapsed time) is obtained as the time information (S304). The reproduction elapsed time indicates a reproduction point of the music piece being played back, which is transmitted from the controller of the CD playback device 202 to the viewer software 103, that is, the current performance point. The current performance point is data indicating which the music piece included in the music CD 101 is being played back at what frame, what second and what minute. The reproduction point of the music CD 101 is conventionally obtained from the CD playback device 202, and displayed, for example, on a display device of the music CD 101.

When the viewer software 103 obtains the time information (playback point), it highlights the word area 4061 corresponding to the phrase being played back, by making a comparison between the phrase start time and the phrase end time, which is the additional information of each phrase, and the current performance point, in order to synchronize them, in a state that the word data is displayed in each word area 4061 similar to the display screen 402 shown in FIG. 9 (S305).

FIG. 19 shows an example of data corresponding to one record in the text file 302 belonging to the CD data file 104. This one record corresponds to one phrase, and stores words, translation, and pronunciation of the translation within one phrase. This record also includes the performance start time of the MIDI karaoke (MIDI phrase start time shown as (3) in this figure) and the performance end time of the MIDI karaoke of this phrase (MIDI phrase end time shown as (4) in this figure), as well as the phrase start time (CD phrase start time shown as (1) in this figure) and the phrase end time (CD phrase end time shown as (2) in this figure) of this phrase in the music piece being played back stored on the music CD 101. The CD phrase start time and the CD phrase end time are represented by data such as a track number, minute, second, and a frame number. The word file has such a record structure, and is used by the viewer software 103 as information for controlling the synchronization and switching of the reproduction of both the music CD 101 and the MIDI karaoke. Assume playing back of only the phrase shown in this figure. In this case, the reproduction is performed for a period of 5 (=25−20) seconds and 26 (=70−44) frames, according to the CD phrase start time and the CD phrase end time.

The example of the data corresponding to one phrase shown in FIG. 19 is only one example, and can be represented in other forms. For example, the data can be managed such that the words, translation, pronunciation and time are managed as separate fields, and corresponding data may be read from each field if the user specifies the line (phrase) of the words.

After switching the highlighted display point in the word area 4061 in synchronization with the playback of the music piece in real time, it is determined whether or not the word area 4061 has been reproduced (S306). The determination is made by comparing the CD phrase end time with the reproduction elapsed time indicating the reproduction point obtained in step S304. If it is determined in step S306 that the performance for one line (one phrase) has not been completed ("NO" in S306), then the process goes back to step S304. If it is determined in step S306 that the performance for one line (one phrase) has been completed ("YES" in S306), then the process goes to step S307.

It is determined in step S307 whether or not the performance of one music piece has been completed. The determination is made by, for example, comparing the performance time of the music piece obtained from the TOC data, with the time information (reproduction point) obtained in step S304.

If it is determined in step S307 that the performance of the music has been completed ("YES" in S307), the process terminates. If it is determined that the performance of the music has not been completed ("NO" in S307), the process goes to step S308. In step S308, whether the re-display of the information area 406 is necessary is determined in step S308. According to the present embodiment, an entire screen (information area 406) is completely switched after all phrases displayed on the screen have been played. Therefore, whether the redisplay of the screen is necessary is determined depending on whether or not the reproduction of the word information (phrase) has been completed in the word area 4061 at the right side of the bottom row of the information area 406 of the display screen 402 in FIG. 9. The determination is made by, for example, comparing the CD phrase end time with the reproduction elapsed time obtained in step S304.

The display of the word information can be switched not only by the switching of the above described screen, but also by a scrolling display in which the word information (phrase) (which has been completely played) is removed from the information area 406. Since the information can be displayed in many other formats, several display formats may be prepared so that the user can arbitrarily select one of them.

If it is determined in step S308 that the data should be re-displayed on the screen (information area 406) ("YES" in S308), then the process goes back to step S303. Thus, new word information is displayed on the screen (information area 406) corresponding to the portion of the music currently being played. If it is determined that the data is not to be redisplayed (information area 406) (NO in S308), then the process goes back to step S304.

Thus, the word information can be displayed on the screen of the CRT 205 in synchronization with the playing of each music piece in the music CD 101. Therefore, the user can sing to the accompaniment of the karaoke in the music CD 101 while watching the screen of the CRT 205.

If the words are written in a foreign language, the translation and pronunciation can be displayed on the screen in the word display mode. When the user selects the word display mode, the user can practice the pronunciation of the foreign language displayed on the display screen 402.

In the word display process, the reproduction of the MIDI karaoke in addition to the reproduction of the music CD 101 can be specified. If the MIDI karaoke is specified, the reproduction is performed based on the reproduction point information and the reproduction elapsed time. Also in this mode, the user can record his or her own performance at any time if the music CD 101 is specified to be reproduced. This recording is instructed by clicking a predetermined button in the CD operation box 404*b*. If this instruction is given, the beginning of the next phrase is searched for, according to the reproduction point information and the reproduction elapsed time. Then, the user performance is recorded for the duration of two phrases at the time of reproducing this phrase.

The continuation of the process shown in FIG. 16 is described below. When the word display process is completed in step S108, it is determined whether or not all music pieces stored on the music CD 101 have been played (S111). If not ("NO" in S111), then the process goes back to step S107. If yes ("YES" in S111), then the process goes back to step S105.

If it is determined in step S107 that the artist information/music information display mode is selected, the artist information/music piece information display process is performed (S109).

Figure 20:
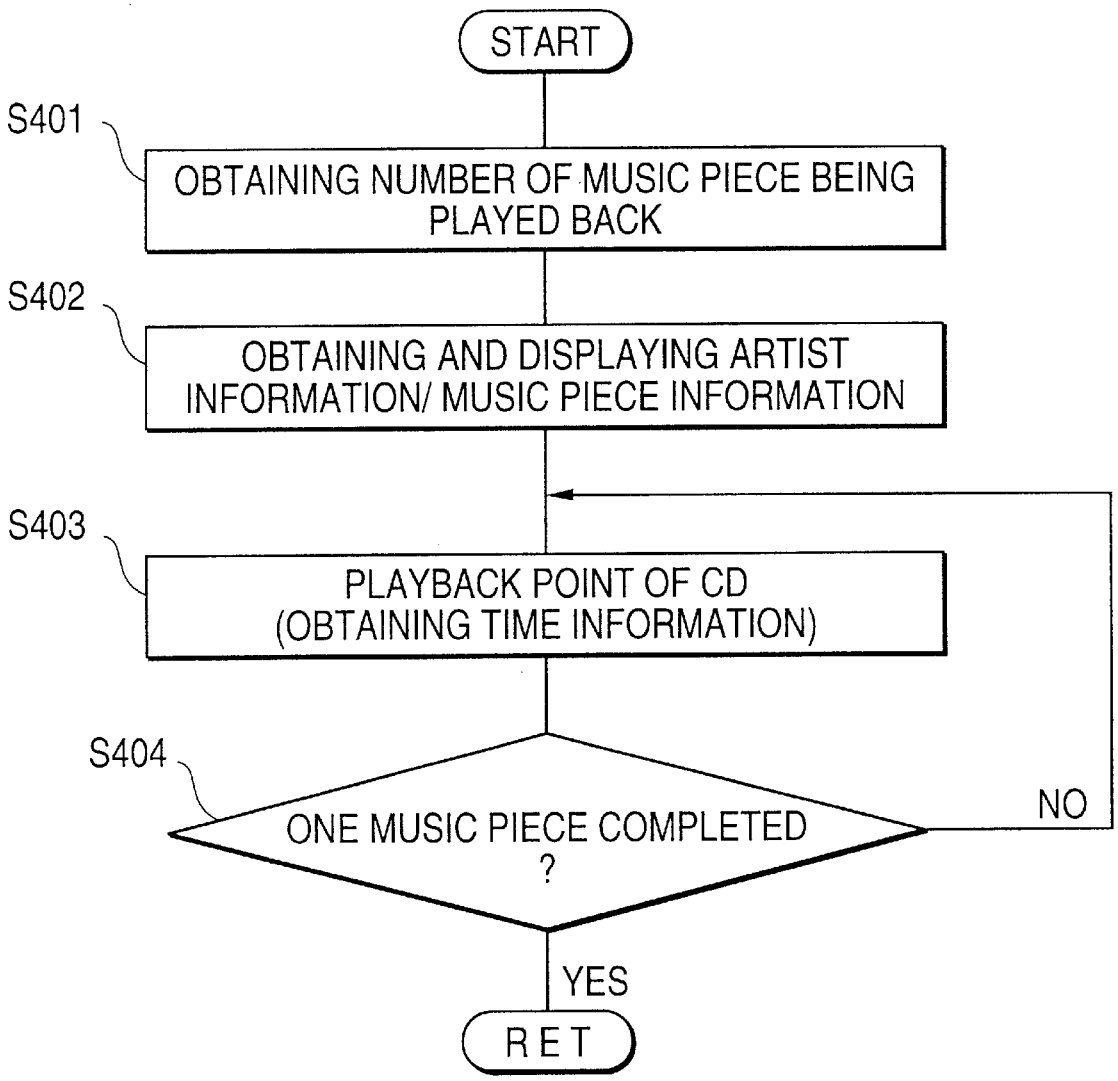
FIG. 20 is a flowchart showing an artist/music piece information display process according to the third embodiment of the present invention.

FIG. 20 is a flowchart showing the artist information/music piece information display process in detail. The artist information/music information display process is described below in detail by referring to this flowchart.

In the artist information/music piece information display process, the number of the music piece currently being played is obtained (S401).

Then, the music piece information 350 and the artist information 340 of the music piece currently being played are obtained, using the obtained music number as key data, from the additional information read from the CD data file 104 corresponding to the music CD 101 loaded into the main storage 106, and currently being played back. The artist information 340 and music piece information 350 are displayed in the information area 406 (refer to FIG. 9) (S402).

The playback point on the music CD 101 currently being played back is obtained from the CD playback device 202 (S403). Then, it is determined whether or not the music piece has been completely played back (S404). The determination as to whether or not the music has been completely played back is made by comparing the reproduction point (time information) obtained in S403 with the performance time obtained from the TOC data. If the music has been completely played back ("YES" in S404), the process terminates. If not ("NO" in S404), then the process goes back to step S403.

If the artist information/music piece information mode is entered, the user can enjoy the music being played back while watching the music piece information 350 by repeating the processes in steps S403 and S404. As described above, the displayed music piece information 350 contains the title and explanation of the music, the cover photo of a single music CD holder storing the music, copyright, etc. The artist information 340 contains the name, photo, and profile (gender, blood type, birthday, etc.) of the artist.

When the above described artist information/music information display process, that is, the process in step S109 shown in FIG. 16, is completed, it is determined whether or not all the music pieces stored on the music CD 101 have been completely played back (S111). That is, if all the music pieces have been completely played back ("YES" in S111), the process goes back to step S105. If not ("NO" in S111), the process goes back to step S107.

If the artist information/music piece information display process, that is, the process of step S109 shown in FIG. 16, is terminated, the process goes to step S111. In this step, reproduction status of the music CD 101 is determined, and the process goes back to step S105 or step S107 according to the result of the determination.

If it is determined in step S107 that the discography mode is selected, the discography display process is performed next (S110).

The discography display process is similar to the above described artist information/music piece information display process. Therefore, the artist information and the information about the artist's albums, etc. (as examples shown in FIG. 15) are displayed in the information area 406 while the music is being played.

Various information about the currently playing music is displayed in synchronization with the playing of the music depending on the selected mode, by repeating the processes in steps S105 through S111. The modes can be selected (switched) by the user's predetermined operations for the input device 201, though details of this process are omitted. The viewer software 103 is informed of the operations, for example, as interrupts, via the device driver software for the input device and the OS 204. The viewer software 103 performs the above described processes driven by the interrupt control. The user can specify any of the modes by clicking the appropriate button, etc. in the mode setting box 404*c*. Therefore, the modes can be switched depending on the music being played from the music CD 101, and the user can see the desired information at any time.

According to the present embodiment, the music piece to be played back can be specified by clicking the desired music piece displayed in the selection list area 405. In the above described process, all music pieces stored on the music CD 101 are listed in the selection list area 405. However, only specifying the name of the desired artist, composer, song writer, etc. can selectively display the desired music piece in the selection list area 405, because the CD data file 104 stores data of the artists, composers, song writers, etc.

Currently, the contents of a single music CD 101 (hereinafter referred to as single CD) are different from those of the old days, such as when music CDs first began to be sold.

Figures 21A, 21B, 21C, 21D:
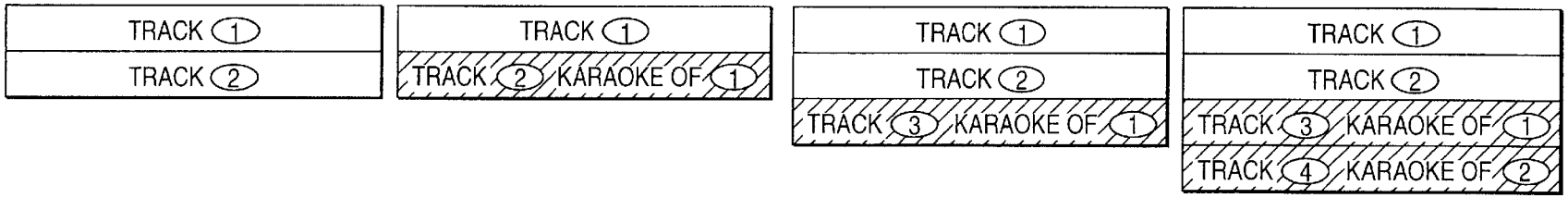
FIG. 21 shows the contents of a single music CD.

FIG. 21 shows a record format of the audio data stored on a single CD 101. The format shown in FIG. 21A is the original one used when the music CDs first began to be marketed. The formats shown in FIGS. 21B through 21D are those of recent days. In these figures, the numbers (1) through (4) indicate the numbers of the tracks consecutively arranged from the first to the last. The tracks storing the performance data of karaoke are shaded. Additionally, each of the tracks includes the performance data of each music piece.

Recently, the number of the music CDs 101 including both the original version of the artist singing and the karaoke version without the artist singing has been increasing. By way of example, on the single CD 101 of the format shown in FIG. 21B, the original version of a certain music piece is stored in the track numbered (1), and its karaoke version is stored in the next track numbered (2). On the single CD of the format shown in FIG. 21C, the original version of the certain music piece is stored in the tracks numbered (1) and (2), and the karaoke version of the music piece whose original version is stored in the track numbered (1), is stored in the track numbered (3). On the single CD of the format shown in FIG. 21D, the original version of the certain music piece is stored in the tracks numbered (1) and (2), and the karaoke version of the certain music piece whose original version is stored in the tracks numbered (1) and (2) is stored in the tracks numbered (3) and (4). The viewer software 103 has a capability to synchronize the reproduction of the audio output data (MIDI karaoke) with the reproduction of the music CD 101 as described above. In the word display mode, the viewer software 103 has an additional capability to switch reproduction of specified word information (phrase) to the reproduction of the music CD 101 or the karaoke version (MIDI karaoke or a recorded user karaoke performance), by specifying the word information divided and displayed in phrases in a plurality of the word areas 4061 on the screen of the CRT 205.

According to this embodiment, in addition to the above described capabilities, a capability to switch a reproduction point of the original version or the karaoke version included in the music CD 101 to an arbitrary point at any time depending on a user specification, using the performance data of the karaoke version often stored on the single music CD as a replacement of the MIDI information in the MIDI file 304, is added in consideration of the recent trend.

Compared with the amount of data used when only the MIDI file 304 is used, the amount of data stored in the auxiliary storage 105 can be reduced. Accordingly, the storage medium storing the viewer software 103 and the CD data file 104 can be provided at a cheaper price without degrading the capabilities. Additionally, music software sold on the market can be used more widely.

If the karaoke performance information of the single music CD 101 is used as the replacement of the MIDI file 304, one record of the word file belonging to the CD data file 104 is structured, for example, such as shown in FIG. 22. Unlike the case of using the MIDI file 304 shown in FIG. 19, the karaoke phrase start time and the karaoke phrase end time are stored instead of the MIDI phrase start time and the MIDI phrase end time, in this case. The karaoke phrase start time and the karaoke phrase end time are represented by data such as a track number, minute, second, and frame number, similar to the original phrase start time and the original phrase end time. The data shown in FIG. 22 corresponds to the single music CD in the format shown in FIG. 21C. The number of the track of the original version is 1, while the number of the track of the karaoke version is 3.

According to this embodiment, the following four types of performance mode are provided to the user:(1) CD performance mode, (2) MIDI karaoke performance mode, (3) original track performance mode, and (4) synchronized performance mode. Functions of these modes are described below. They are switched in a cyclic order by clicking the switch button 501 in the display area 4061, (as shown in FIG. 12).

(1) CD performance mode: Plays back the original version by an artist stored on the music CD 101.

(2) karaoke performance mode: Plays back the karaoke version using the MIDI data for the MIDI karaoke performance stored on the music CD 101 or the performance data of the karaoke version stored on the music CD 101 (single CD).

(3) user performance mode: Plays back recorded user performance.

(4) synchronized performance mode: Synchronizes and plays back the original version by the artist stored on the music CD 101 and the recorded user performance.

Figure 23:
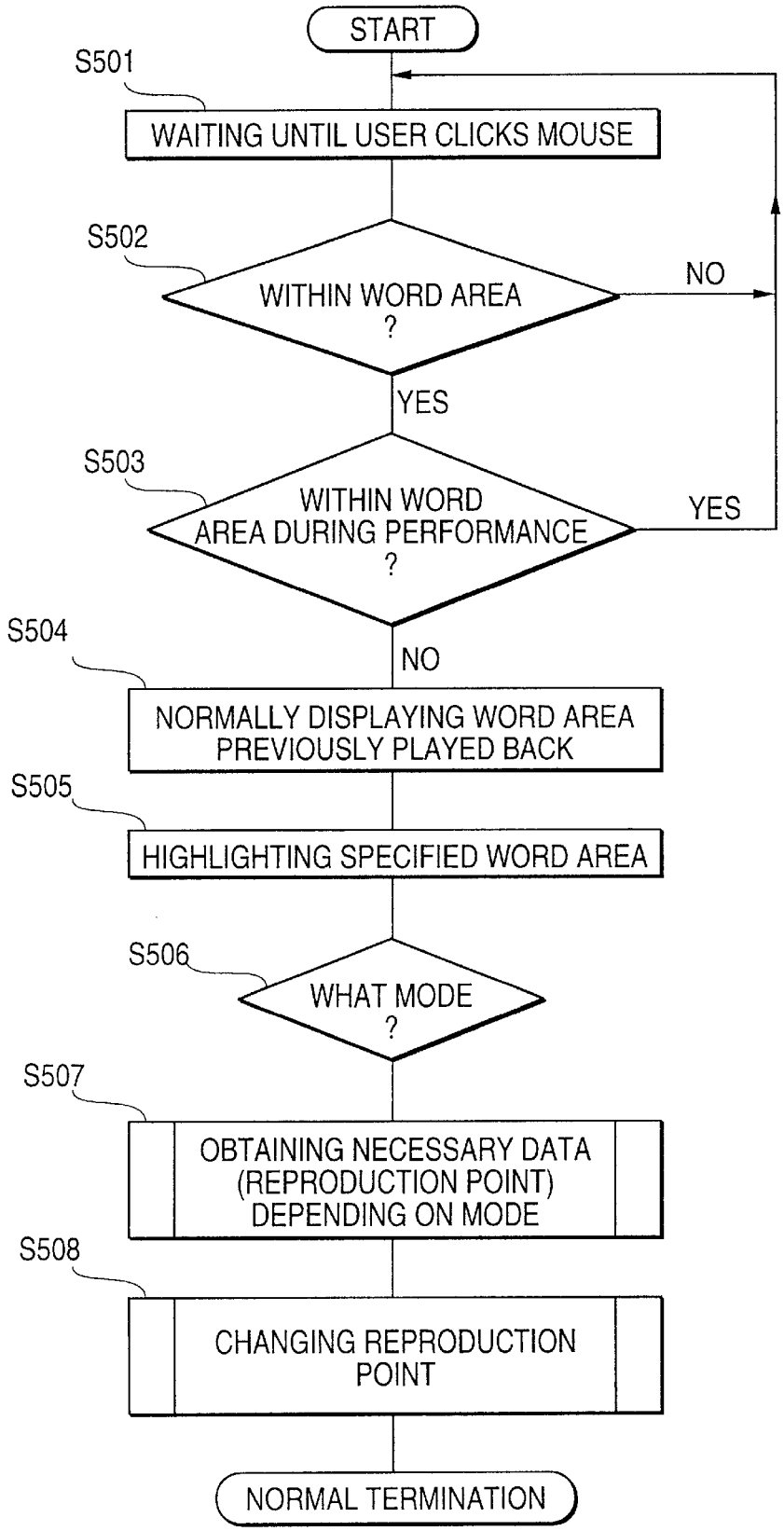
FIG. 23 is a flowchart showing a reproduction point changing process according to the third embodiment of the present invention.

FIG. 23 is a flowchart showing the reproduction point changing process for changing a reproduction point of a music piece being played back in one of the above described modes (1) through (4) in phrases, according to a specification made by the user, when entering the word display mode.

The viewer software 103 is in a state of waiting for an event of a user clicking on the screen of the CRT 205. When the user performs the clicking, the viewer software 103 obtains position information of the clicking (display position information of the mouse cursor), via the mouse device driver software among the group of device driver software 203 and the OS 204 (S501). When the display position information is obtained, the viewer software 103 determines whether or not the mouse cursor is positioned in the word area 4061 at the time of the clicking, according to the display position information (S502).

Figure 24A:
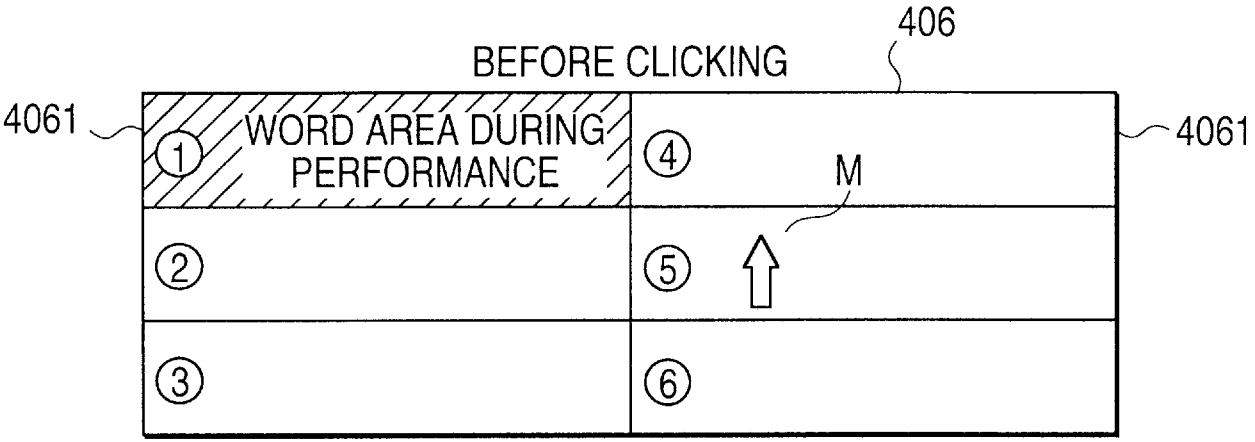
FIGS. 24A and 24B show a changed portion of a performance.
Figure 24B:
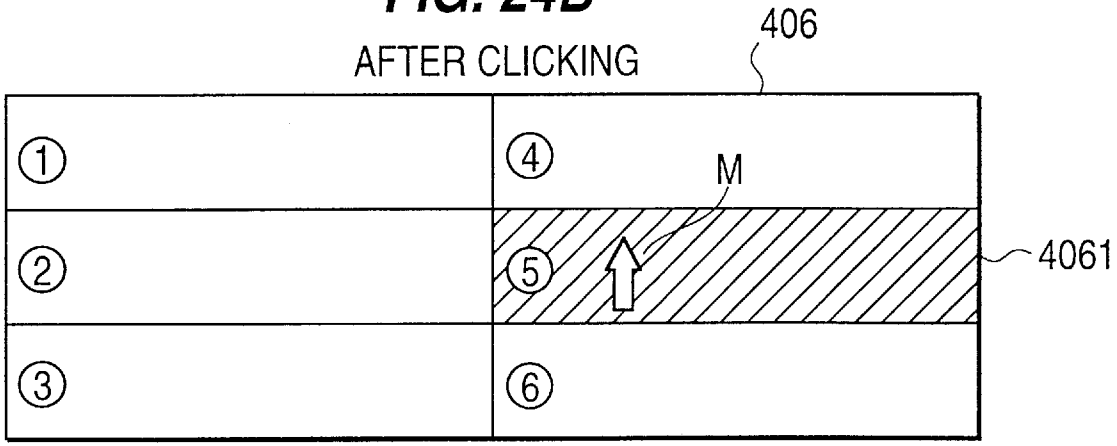

Explanation of an example of the above described clicking by the user is provided below referring to FIG. 24. The information area 406 is divided into, for example, 6 word areas 4061 as shown in FIG. 24. However, words are not always displayed in all of the six word areas, and the clicking may be performed in another display area (such as the selection area 405, etc.). In this figure, the numbers (1) through (6) indicate an identification number of the word area 4061, and the order of phrases to be performed at the same time. FIG. 24A is the screen before being clicked by the user, in which the word area 4061 corresponding to the phrase (1) being played back is highlighted. At this time, the mouse cursor M is positioned in the word area 4061 (5).

Since the reproduction point is specified by the word information of the phrase displayed in the word area 4061 as described above, the user can easily specify the reproduction point and the load on the user required for the changing operation of the reproduction point is alleviated.

In FIG. 23, if the position of the mouse cursor is outside the word area 4061 at the time of the clicking in step S502 (S502, NO), the process goes back to step S501, and waits for a new clicking. On the other hand, if the display position of the mouse cursor is inside the word area 4061 (S502, YES), then it is determined whether or not the position of the mouse cursor is inside the word area 4061 being played back (S503). If it is determined that the position of the mouse cursor is inside the word area 4061 being played back (S503, YES), the process goes back to step S501.

If it is determined that the position of the mouse cursor is outside the word area 4061 being played back (S503, NO), the word area 4061 corresponding to the phrase being played back is normally displayed (S504). Then, the word area 4061 specified by the user clicking is highlighted (S505).

Thus, the screen of the CRT 205 changes from the one shown in FIGS. 24A to the one shown in 24B.

After the word area 4061 specified by the user is highlighted, the currently-specified mode is determined (S506). Then, according to the determined mode, data required for playing back the music piece is obtained (S507). If the determined mode is the CD performance mode, corresponding word data is read from the word file belonging to the CD data file 104, so that the CD phrase start time and the CD phrase end time are obtained. If the determined mode is the MIDI karaoke performance mode, the MIDI phrase start time and the MIDI phrase end time are also obtained from the word file. If the determined mode is the original track performance mode, the original phrase start time and the original phrase end time are also obtained from the word file. If the determined mode is the synchronized performance mode, the karaoke phrase start time and the karaoke phrase end time are also obtained from the word file, and user recorded data is additionally obtained. The user recorded data is played back when it matches the music piece and the phrase being played back at the time of recording this data.

In step S508, the reproduction point of the music CD 101 is changed via the OS 204 and the device driver software for the CD playback device, according to the obtained data (such as the reproduction point of the music CD 101, etc.). In the synchronized playback mode, the user karaoke performance data is additionally obtained from the main storage 106 or the auxiliary storage 105. The obtained data is outputted to the DAC 212*b* via the device driver software for playback.

Upon termination of the process performed in step S508, playback of the music piece is started in a mode selected by the user. The viewer software 103 monitors the reproduction elapsed time from the beginning of the playback, and continues to play back the music piece for the duration obtained by the reproduction point information (CD phrase start time and CD phrase end time). After the playback terminates, the viewer software 103 re-enters the state of waiting for a user clicking.

As described above, according to the present invention, a music piece can be played back at any point within the music piece regardless of a data type to be reproduced. Accordingly, a user can intensively practice a portion of the music piece that he or she cannot sing well, so that efficiency of the practice is improved and of the practice can be obtained. If the user specifies the synchronized performance mode at that time, the user can compare an artist's singing with own singing, so that he or she can identify his or her own singing capability, weak points, etc. This leads to highly efffective practise of the practice.

The above described reproduction point changing process changes a reproduction point by displaying the word information in phrases and specifying a desired phrase. The reproduction point may be changed by specifying the reproduction elapsed time from the beginning of a music piece. Otherwise, the reproduction point may be changed according to a number respectively assigned to other possibly reproduction points in advance. Furthermore, an arbitrary reproduction point may be specified not only for one music piece, but also for a plurality of music pieces.

According to the above described reproduction point changing process, performance data to be reproduced, and the reproduction point in the music piece, are specified in phrases. However, in the state that the word areas are displayed on a screen of the CRT 205 as shown in FIG. 24, a type of the performance data to be reproduced may be specified for each word area 4061 (phrase) by a user. With this procedure, the user can enjoy a duet alone by pre-specifying the word area 4061 which the user sings as the MIDI karaoke, and another word area as an original version of the music CD, when singing a karaoke version of the duet. This is implemented by, for example, using the capability generally supported for the mixer 208, and switching between the reproduction of the MIDI karaoke and the reproduction of the music CD 101 in turn. Though the MIDI file (MIDI karaoke) 304 corresponding to the music CD 101 is provided as the additional information according to this embodiment, not only the karaoke version but also a sound that can be reproduced as a background of the original, such as background music, may be provided as the additional information.

The discography mode according to the present embodiment only displays information of various music CDs 101. By adding communications capabilities to the viewer software 103, various effects can be obtained.

First of all, since the information of various music CDs 101 can be displayed on the screen of the CRT 205, it can be used as an advertisement, for purchase of a desired music CD 101 (what is called online shopping), and payment of the charge for the purchased music CD 101 can be made while watching the displayed advertisement.

Furthermore, adding a capability of receiving (downloading) the additional information of the music CD 101 eliminates the need of purchasing a storage medium that stores the additional information when purchasing the music CD 101. As a result, various music CDs 101 can flexibly be reproduced. Since the additional information may be downloaded into the auxiliary storage 105 depending on need, the size of storage required for storing the additional information can be reduced, and the auxiliary storage 105 can be used for a wider range of purposes.

In FIG. 19, the additional information of the MIDI reproduction data such as the artist information, the discography information, etc. may be selected and displayed in addition to displaying words, translation, and pronunciation, in synchronization with the MIDI reproduction data, by searching for the CD phrase start time and the CD phrase end time using the MIDI phrase start time and the MIDI phrase end time as keys. At that time, a data structure such as the one where the word information and the artist information are displayed in multi-windows, or the one where the word information as well as the artist information are displayed, may be adopted.

As described above, the karaoke system according to the first and the third embodiments of the present invention, synchronizes and reproduces performance information respectively stored on different storage media, for example, reproduction data of an original version of a certain music piece and reproduction data of a karaoke version of the certain music piece, by switching them according to a specification made by a user. Accordingly, the user can intensively listen to a desired portion of a music piece, or sing to the reproduced tune of the music piece.

The karaoke system according to the second and the third embodiments of the present invention records user music data inputted to the reproduced tune of the music piece, and plays back the recorded user music data in synchronization with the reproduction of the music piece. Accordingly, the user can easily compare the artist's singing with his or her own singing, so that he or she can identify his or her own singing capability and weak points objectively.

The karaoke system according to the fourth embodiment of the present invention moves a reproduction point of the music piece to an arbitrary point within the music piece according to a specification made by the user. Accordingly, the user can repeatedly and intensively practice a desired portion of the music piece.

The karaoke system according to the fifth embodiment of the present invention changes the reproduction point of the music piece according to an arbitrary reproduction point and a performance type specified by the user, if the performance data of different performance types are respectively stored in different storage areas of a storage medium. Accordingly, the user can listen to a desired portion of the music piece of desired performance type at any time. If one of the performance types is the karaoke version, the user can intensively and repeatedly practice a desired portion of a music piece.

According to any of the above described embodiments, the user can obtain a highly effective practice. If any of the above embodiments are combined, more effective practice can be obtained.

What is claimed is:

1. A karaoke system, comprising:

first reading means for reading performance data of a music piece including a song stored on a first storage medium;

second reading means for reading performance data of a karaoke version of said music piece stored on a second storage medium;

control means for synchronizing the performance data read by said first reading means and the performance data read by said second reading means; and reproducing means for reproducing the performance data read by the first reading means and the performance data read by the second reading means as synchronized by the control means.

2. The karaoke system according to claim 1, wherein:

said control means causes said reproducing means to reproduce the performance data read by either of said first reading means and said second reading means, depending on a setting.

3. The karaoke system according to claim 1, further comprising a single driving device for driving said first and second storage mediums wherein:

when said system is configured with a computer and said first storage medium and said second storage medium are accessed by the single driving device equipped in the computer, the performance data stored on either said first storage medium or said second storage medium is written to at least one of a main storage device and disk; and at least one of the main storage device and the disk is used as either said first storage medium or said second storage medium.

4. The karaoke system according to claim 1, wherein:

said first storage medium comprises a music disk for storing a song and performance data;

said second storage medium comprises a memory storing the performance data of the song; and the performance data stored on the memory is written to at least one of a main storage device and a disk.

5. The karaoke system according to claim 1, wherein:

said control means synchronizes reproduction of the performance data stored on said second storage medium with reproduction of the performance data stored on said first storage medium, according to prepared performance time information of the performance data stored on said first storage medium.

6. The karaoke system according to claim 5, wherein:

the performance time information is provided in a predetermined unit; and said control means controls, using the performance time information in the predetermined unit, a start of the reproduction and a synchronization of the performance data stored on said first storage medium and said second storage medium in the predetermined unit.

7. The karaoke system according to claim 1, further comprising:

identifying means for identifying said first storage medium according to predetermined data stored on said first storage medium read by said first reading means, and causing said second reading means to read the performance data stored on said second storage medium corresponding to the performance data stored on said first storage medium.

8. The karaoke system according to claim 7, wherein:

if said first storage medium is a music disk, said identifying means extracts predetermined data from table of contents data in a read-in area by reading from the music disk by said first reading means, and identifies said first storage medium by comparing the extracted predetermined data with identification information for use in identifying said first storage medium, prepared in said second storage medium, corresponding to the predetermined data.

9. The karaoke system according to claim 8, wherein:

the predetermined data is at least one of total performance time, total number of music pieces, and performance time of each music piece, including in the music disk.

10. The karaoke system according to claim 7, wherein:

said second reading means reads artist information or music piece information corresponding to said first storage medium from said second storage medium, according to a result identified by said identifying means; and said control means displays the music piece information read from said second storage medium in synchronization with the reproduction of the performance data by said reproducing means.

11. The karaoke system according to claim 10, wherein:

the music piece information includes at least one of words, translation of the words, and pronunciation of the translated words, corresponding to the performance data reproduced by said reproducing means.

12. The karaoke system according to claim 1, wherein:

a reproduction point of said first storage medium is changed according to an arbitrarily-specified reproduction point of said second storage medium.

13. The karaoke system according to claim 1, wherein:

said first storage medium is the music CD (compact disk).

14. A karaoke system, comprising:

first reading means for reading performance data of a music piece including a song stored on a first storage medium;

reproducing means for reproducing the performance data read by said first reading means;

recording means for recording music data input by a user on a second storage medium in synchronization with the reproduction of the performance data stored on said first storage medium by said reproducing means;

second reading means for reading the music data recorded on said second storage medium by said recording means; and control means for causing said reproducing means to reproduce the music data read by said second reading means in synchronization with the reproduction of the performance data, when said reproducing means reproduces the performance data read by said first reading means.

15. The karaoke system according to claim 14, wherein:

said control means causes said reproducing means to reproduce either the performance data read by said first reading means or the music data read by said second reading means, depending on the user setting.

16. The karaoke system according to claim 14, wherein:

said control means synchronizes reproduction of the music data recorded on said second storage medium with the reproduction of the performance data stored on said first storage medium, according to prepared performance time information of the performance data stored on said first storage medium.

17. The karaoke system according to claim 16, wherein:

the performance time information is provided in a predetermined unit; and said control means controls, using the performance time information in the predetermined unit, a start of the reproduction and a synchronization of the data stored on said first storage medium and said second storage medium in the predetermined unit.

18. The karaoke system according to claim 14, wherein:

said first storage medium is a music disk.

19. A karaoke system, comprising:

first reading means for reading performance data stored on a first storage medium;

second reading means for reading performance data stored on a second storage medium;

reproducing means for respectively reproducing the performance data read by said first reading means and said second reading means;

recording means for recording the music data, which is inputted by the user in synchronization with the performance data read by at least one of said first reading means and said second reading means, reproduced by said reproducing means, on a third storage medium;

third reading means for reading the music data recorded on said third storage medium by said recording means; and control means for making said reproducing means reproduce the music data read by said third reading means in synchronization with the reproduction of the performance data, when said reproducing means reproduces the performance data read by at least one of said first reading means and the second reading means.

20. The karaoke system according to claim 19, wherein:

when said system is configured with a personal computer and said first storage medium and said second storage medium are accessed by an identical driving device equipped in the personal computer, the performance data stored on either said first storage medium or said second storage medium is written to at least one of a main storage device and a magnetic disk; and at least one of the main storage device and the magnetic disk is used as either said first storage medium or said second storage medium.

21. The karaoke system according to claim 19, wherein:

when the CD-ROM storing the performance data is provided as said second storage medium, the performance data stored on the CD-ROM is written to at least one of the main storage medium and the magnetic disk.

22. The karaoke system according to claim 19, wherein:

said control means synchronizes both the reproduction of the performance data stored on said second storage medium and the music data stored on said third storage medium with the reproduction of the performance data stored on said first storage medium, according to prepared performance time information of the performance data stored on said first storage medium.

23. The karaoke system according to claim 22, wherein:

the performance time information is provided in a predetermined unit; and said control means controls, using the performance time information in the predetermined unit, a start of the reproduction and a synchronization of the performance data stored on said first storage medium and said second storage medium, and the music data stored on said third storage medium in the predetermined unit.

24. The karaoke system according to claim 19, further comprising:

identifying means for identifying said first storage medium according to predetermined data stored on said first storage medium read by said first reading means, and making said second reading means read the performance data stored on said second storage medium corresponding to the performance data stored on said first storage medium.

25. The karaoke system according to claim 24, wherein:

if said first storage medium is a music CD (compact disk), said identifying means extracts predetermined data from TOC (Table of Contents) data in a read-in area by reading from the music CD by said first reading means, and identifies said first storage medium by comparing the extracted predetermined data with identification information for use in identifying said first storage medium, prepared in said second storage medium, corresponding to the predetermined data.

26. The karaoke system according to claim 25, wherein:

the predetermined data is at least one of total performance time, total number of music pieces, and performance time of each music piece, included in the music CD.

27. The karaoke system according to claim 24, wherein said second reading means reads the artist information or the music piece information corresponding to said first storage medium from said second storage medium, according to a result identified by said identifying means; and said control means displays the music piece information read from said second storage medium in synchronization with the reproduction of the performance data by said reproducing means.

28. The karaoke system according to claim 27, wherein:

the music piece information includes at least one of words, translation of the words, and pronunciation of the translated words, corresponding to the performance data reproduced by said reproducing means.

29. The karaoke system according to claim 19, wherein:

a reproduction point of said first storage medium is changed according to an arbitrarily-specified reproduction point of said second storage medium.

30. The karaoke system according to claim 19, wherein:

said first storage medium is a music CD (compact disk).

31. The karaoke system according to claim 19, wherein:

the performance data stored on said first storage medium is an original of the music piece, and the performance data stored on said second storage medium is a karaoke version.

32. A configuration method for configuring a karaoke system, comprising the steps of:

equipping a personal computer with at least one driving device accessible to said first storage medium and said second storage medium, a sound reproduction unit, and a recording means for recording music data inputted by a user; and loading a program for synchronizing performance data read from at least one of said first storage medium and said second storage medium by said driving device with the music data recorded by said recording means, and for reproducing the data by the sound reproduction unit.

33. A karaoke system, comprising:

reading means for reading performance data of different performance types of an identical music piece from different storage areas of a storage medium;

reproducing means for reproducing the performance data read by said reading means;

reproduction point specifying means for specifying a reproduction point in the music piece;

performance type specifying means for specifying the performance data of different performance types stored in different storage areas; and control means for changing the reproduction point from which the performance data is read by said reading means, according to a specification of the reproduction point made by said reproduction point specifying means and a specification of the performance type made by said performance type specifying means, when at least one of the specifications is made.

34. The karaoke system according to claim 33, wherein:

said reproduction point specifying means specifies the reproduction point using a phrase of a music piece as a unit.

35. The karaoke system according to claim 33, wherein:

when said reproduction point specifying means specifies an arbitrary phrase as the reproduction point, said control means obtains performance time information of the specified phrase from prepared performance time information of each phrase, and reproduces the performance data stored on said storage medium corresponding to the specified phrase according to the obtained performance time information.

36. The karaoke system according to claim 33, wherein:

said storage medium is a music disk.

37. The karaoke system according to claim 33, wherein:

one of the performance data of different performance types is an original and the other is a karaoke version.

38. A configuration method for configuring a karaoke system, comprising the steps of:

equipping a personal computer with a driving device accessible to a storage medium, and a sound reproduction unit; and loading a program for making a user specify a reproduction point of performance data and a performance type of the performance data stored on said storage medium in a predetermined unit, and changing the reproduction point from which the driving device reads the performance data according to the specified reproduction point and the performance type, for reproducing the data by the sound reproduction unit, wherein the performance type is one of the group consisting of performance of a music piece including a song and performance of a karaoke version of said music piece.

39. A method comprising the steps of:

a first step of reading performance data of a music piece including a song stored on a first storage medium;

a second step of reading performance data of a karaoke version of said music piece stored on a second storage medium;

a third step of synchronizing the performance data read in the first step and the performance data read in the second step; and a fourth step of reproducing the performance data read in the first step and the performance data read in the second step as synchronized in the third step.

40. A method comprising the steps of:

a first step of reading performance data of a music piece including a song stored on a first storage medium;

a second step of reproducing the performance data read in the first step;

a third step of recording music data input by a user on a second storage medium in synchronization with the reproduction of the performance data in said second step;

a fourth step of reading the music data recorded on said second storage medium in the third step, a fifth step of, when the second step reproduces the performance data read in the first step, reproducing the music data read in the fourth step in synchronization with the reproducing of the performance data.

41. A method comprising the steps of:

a first step of reading performance data stored on a first storage medium;

a second step of reading performance data stored on a second storage medium;

a third step of reproducing the performance data read in the first and second steps;

a fourth step of recording music data, which is input by a user in synchronization with the performance data read in at least one of said first and second steps and reproduced in said third step, on a third storage medium;

a fifth step of reading the music data recorded on said third storage medium in the fourth step; and a sixth step of reproducing the music data read in the fifth step in synchronization with the reproduction of performance data in the third step.

42. A method comprising the step of:

a first step of reading performance data of different performance types of an identical music piece from different storage areas of a storage medium;

a second step of reproducing the performance data read in the first step;

a third step of specifying a reproduction point in the music piece;

a fourth step of specifying the performance data of different performance types stored in different storage areas; and a fifth step of changing the reproduction point from which the performance data is read in the first step, according to a specification of the reproduction point made in the third step and a specification of the performance type made in the fourth step, when at least one of the specifications is made.

43. A computer readable medium used to direct a computer to perform:

a first step of reading performance data of a music piece including a song stored on a first storage medium;

a second step of reading performance data of a karaoke version of said music piece stored on a second storage medium;

a third step of synchronizing the performance data read in the first step and the performance data read in the second step; and a fourth step of reproducing the performance data read in the first step and the performance data read in the second step as synchronized in the third step.

44. A computer readable medium used to direct a computer to perform:

a first step of reading performance data of a music piece including a song stored on a first storage medium;

a second step of reproducing the performance data read in the first step;

a third step of recording music data input by a user on a second storage medium in synchronization with the reproduction of the performance data in said second step;

a fourth step of reading the music data recorded on said second storage medium in the third step, a fifth step of, when the second step reproduces the performance data read in the first step, reproducing the music data read in the fourth step in synchronization with the reproducing of the performance data.

45. A computer readable medium used to direct a computer to perform:

a first step of reading performance data stored on a first storage medium;

a second step of reading performance data stored on a second storage medium;

a third step of reproducing the performance data read in the first and second steps;

a fourth step of recording music data, which is input by a user in synchronization with the performance data read in at least one of said first and second steps and reproduced in said third step, on a third storage medium;

a fifth step of reading the music data recorded on said third storage medium in the fourth step; and a sixth step of reproducing the music data read in the fifth step in synchronization with the reproduction of performance data in the third step.

46. A computer readable medium used to direct a computer to perform:

a first step of reading performance data of different performance types of an identical music piece from different storage areas of a storage medium;

a second step of reproducing the performance data read in the first step;

a third step of specifying a reproduction point in the music piece;

a fourth step of specifying the performance data of different performance types stored in different storage areas; and a fifth step of changing the reproduction point from which the performance data is read in the first step, according to a specification of the reproduction point made in the third step and a specification of the performance type made in the fourth step, when at least one of the specifications is made.

47. A method comprising the steps of:

a first step of reading performance data stored on a first storage medium;

a second step of reading performance data stored on a second storage medium;

a third step of reproducing the performance data read in the first and second steps;

a fourth step of recording music data, which is input by a user in synchronization with the performance data read in at least one of said first and second steps and reproduced in said third step, on a third storage medium;

a fifth step of reading the music data recorded on said third storage medium in the fourth step; and a sixth step of reproducing the music data read in the fifth step in synchronization with the reproduction of performance data read in at least one of the first and second steps and reproduced in the third step.

48. A computer readable medium used to direct a computer to perform:

a first step of reading performance data stored on a first storage medium;

a second step of reading performance data stored on a second storage medium;

a third step of reproducing the performance data read in the first and second steps;

a fourth step of recording music data, which is input by a user in synchronization with the performance data read in at least one of said first and second steps and reproduced in said third step, on a third storage medium;

a fifth step of reading the music data recorded on said third storage medium in the fourth step; and a sixth step of reproducing the music data read in the fifth step in synchronization with the reproduction of performance data read in at least one of the first and second steps and reproduced in the third step.

* * * * *

UNITED STATES PATENT AND TRADEMARK OFFICE

CERTIFICATE OF CORRECTION

PATENT NO.: 5,880,388
DATED : March 9, 1999
INVENTOR(S): Kajiyama et al.

It is certified that error appears in the above-identified patent and that said Letters Patent is hereby corrected as shown below:

Title Page [75] , line 2 "Inagi" should be --Tokyo--.

Col. 15, line 33, before "FIG. 16" (second occurrence), BEGIN A NEW PARAGRAPH.

Col. 29, line 17, delete "respectively";
line 21, "inputted by the" should be --input by a--;
line 23, "means," should be --means and--; (2nd occurrence)
line 28, "making" should be --causing--; after "means" (second occurrence) insert --to--;
line 30, delete "the" (second occurrence);
line 33, "the" should be --said--.

UNITED STATES PATENT AND TRADEMARK OFFICE

CERTIFICATE OF CORRECTION

PATENT NO.: 5,880,388
DATED : March 9, 1999
INVENTOR(S): Kajiyama et al.

It is certified that error appears in the above-identified patent and that said Letters Patent is hereby corrected as shown below:

Col. 30, line 6, "making" should be --causing--; after "means" insert --to--;
line 25, delete "the";
line 26, delete "the";
line 47, "the" (first occurrence) should be --a--;
line 53, "said" (first occurrence) should be --a--; "medium and said" should be --medium,--;
line 54, before "second" insert --a--;
line 55, "inputted" should be --input--.

Signed and Sealed this

Nineteenth Day of October, 1999

*Attest:*

Q. TODD DICKINSON

*Attesting Officer*

*Acting Commissioner of Patents and Trademarks*